US008738385B2

(12) United States Patent
Chen

(10) Patent No.: US 8,738,385 B2
(45) Date of Patent: May 27, 2014

(54) PITCH-BASED PRE-FILTERING AND POST-FILTERING FOR COMPRESSION OF AUDIO SIGNALS

(75) Inventor: Juin-Hwey Chen, Irvine, CA (US)

(73) Assignee: Broadcom Corporation, Irvine, CA (US)

( * ) Notice: Subject to any disclaimer, the term of this patent is extended or adjusted under 35 U.S.C. 154(b) by 502 days.

(21) Appl. No.: 13/172,134

(22) Filed: Jun. 29, 2011

(65) Prior Publication Data

US 2012/0101824 A1 Apr. 26, 2012

Related U.S. Application Data

(60) Provisional application No. 61/394,842, filed on Oct. 20, 2010, provisional application No. 61/406,106, filed on Oct. 22, 2010.

(51) Int. Cl.
*G10L 21/00* (2013.01)

(52) U.S. Cl.
USPC ..... 704/500; 704/219; 375/240.29

(58) Field of Classification Search
USPC ..... 704/219, 500; 375/240.29
See application file for complete search history.

(56) References Cited

U.S. PATENT DOCUMENTS

| | | | | |
|---|---|---|---|---|
| 5,664,055 | A * | 9/1997 | Kroon | 704/223 |
| 7,933,769 | B2 * | 4/2011 | Bessette | 704/219 |
| 2011/0282656 | A1 * | 11/2011 | Grancharov et al. | 704/203 |

* cited by examiner

*Primary Examiner* — Daniel D Abebe
(74) *Attorney, Agent, or Firm* — Fiala & Weaver P.L.L.C.

(57) ABSTRACT

Systems and methods for enhancing the quality of an audio signal produced by an audio codec are described herein. In accordance with the systems and methods, a pitch-based pre-filter adaptively filters an input audio signal to produce a filtered audio signal. An audio encoder encodes the filtered audio signal to generate a compressed audio bit stream. An audio decoder decodes the compressed audio bit stream to generate a decoded audio signal. A pitch-based post-filter adaptively filters the decoded audio signal to produce an output audio signal, wherein adaptively filtering the decoded audio signal comprises undoing at least part of a signal-shaping effect of the pitch-based pre-filter.

21 Claims, 13 Drawing Sheets

PITCH-BASED PRE-FILTERING AND POST-FILTERING FOR COMPRESSION OF AUDIO SIGNALS

CROSS-REFERENCE TO RELATED APPLICATIONS

The present application claims priority to U.S. Provisional Patent Application No. 61/394,842, filed on Oct. 20, 2010 and U.S. Provisional Patent Application No. 61/406,106, filed on Oct. 22, 2010, the entirety of which are incorporated by reference herein.

BACKGROUND OF THE INVENTION

1. Field of the Invention

The present invention generally relates to systems that encode audio signals, such as music and speech signals, for transmission or storage and/or that decode encoded audio signals for playback.

2. Background

Audio coding refers to the application of data compression to audio signals such as music and speech signals. In audio coding, a "coder" encodes an input audio signal into a digital bit stream for transmission or storage, and a "decoder" decodes the bit stream into an output audio signal. The combination of the coder and the decoder is called a "codec." The goal of audio coding is usually to reduce the encoding bit rate while maintaining a certain degree of perceptual audio quality. For this reason, audio coding is sometimes referred to as "audio compression."

Traditional audio codecs are typically transform audio codecs that employ a large transform window size between 20 and 50 milliseconds (ms). The large transform window size results in a fairly long coding delay. In certain applications of audio coding, such as tele-presence, in-game voice chat, and on-line live music performance by musicians in different places, it is necessary to maintain a low end-to-end delay. Some of these applications also require low codec complexity, especially when a battery-operated wireless device such as a Bluetooth™ stereo headset is involved. There exists low-delay and low-complexity transform audio codecs that use small transform window sizes below 10 ms to achieve low coding delays and low codec complexity. Examples of such low-delay transform audio codecs include the Constrained Energy Lapped Transform (CELT) codec (http://www.celt-codec.org) as described by J.-M. Valin, et al. in "A High-Quality Speech and Audio Codec With Less Than 10 ms delay," *IEEE Transaction on Audio, Speech, and Language Processing*, Vol. 18, No. 1, January, 2010, and the HF64 audio codec described by J.-H. Chen in "A High-Fidelity Speech and Audio Codec With Low Delay and Low Complexity," *Proceedings of* 2000 *IEEE International Conference on Acoustics, Speech, and Signal Processing*, Vol. 2, pp. II-1161 to II-1164 and in U.S. Pat. No. 6,351,730.

An inherent limitation of such low-delay transform audio codecs employing small transform window sizes is that the frequency resolution of such transforms is insufficient to resolve the pitch harmonics of some of the nearly periodic segments of music and speech signals. As a result, such low-delay transform codecs tends to produce more audible coding distortion when encoding nearly periodic music and speech signals, even though the coding performance may be fine for other non-periodic signals. Increasing the transform window size will enable the pitch harmonics to be resolved and thus exploited to reduce such distortion for periodic music and speech signals, but will also increase the coding delay and codec complexity.

What is needed, then, is a technique to improve the output audio quality of an audio codec that cannot effectively exploit pitch redundancy in an input audio signal to reduce distortion when such signal exhibits significant pitch periodicity. As noted above, such audio codecs may include low-delay transform audio codecs such as CELT and HF64.

BRIEF SUMMARY OF THE INVENTION

Systems and methods are described herein for enhancing the output audio quality of audio codecs that cannot effectively exploit pitch redundancy in an input audio signal to reduce distortion when such signal exhibits significant pitch periodicity. Examples of audio codecs that can benefit from the systems and methods described herein include low-delay transform audio codecs such as CELT and HF64. However, an audio codec does not have to be a low-delay audio codec or a transform audio codec to benefit from the systems and methods described herein. For example, the systems and methods described herein may potentially be used to enhance the output audio quality of any audio codec that does not explicitly exploit the inherent near-periodicity in some of its input signals to reduce coding distortion. In accordance with certain embodiments, the systems and methods described herein can be used in conjunction with an audio codec without increasing coding delay and with only a slight increase in the encoding bit-rate and codec complexity.

In particular, a system for enhancing the quality of an audio signal produced by an audio codec is described herein. The system includes a pitch-based pre-filter, an audio encoder, an audio decoder, and a pitch-based post-filter. The pitch-based pre-filter adaptively filters an input audio signal to produce a filtered audio signal, wherein adaptively filtering the input audio signal comprises filtering each of a plurality of segments of the input audio signal in a manner that is dependent upon an estimated pitch period associated therewith. The audio encoder encodes the filtered audio signal to generate a compressed audio bit stream. The audio decoder decodes the compressed audio bit stream to generate a decoded audio signal. The pitch-based post-filter adaptively filters the decoded audio signal to produce an output audio signal, wherein adaptively filtering the decoded audio signal comprises filtering each of a plurality of segments of the decoded audio signal in a manner that is dependent upon an estimated pitch period associated therewith, and wherein the pitch-based post-filter operates to undo at least part of a signal-shaping effect of the pitch-based pre-filter.

In one embodiment, the pitch-based pre-filter performs adaptive comb filtering of the input audio signal to suppress pitch harmonic peaks in the frequency domain when the input audio signal exhibits pitch periodicity and the pitch-based post-filter performs adaptive comb filtering of the decoded audio signal to boost pitch harmonic peaks in the frequency domain when the decoded audio signal exhibits pitch periodicity.

In an alternate embodiment, the pitch-based pre-filter performs adaptive comb filtering of the input audio signal to boost spectral valleys between pitch harmonics in the frequency domain when the input audio signal exhibits pitch periodicity and the pitch-based post-filter performs adaptive comb filtering of the decoded audio signal to attenuate spectral valleys between pitch harmonics in the frequency domain when the decoded audio signal exhibits pitch periodicity.

A method for enhancing the quality of an audio signal produced by an audio codec is also described herein. In accordance with the method, each of a plurality of segments of an input audio signal are filtered by a pitch-based pre-filter in a manner that is dependent upon an estimated pitch period associated therewith to produce a filtered audio signal. The filtered audio signal is then encoded in an audio encoder to generate a compressed audio bit stream. The compressed audio bit stream is then provided to a system that includes an audio decoder that decodes the compressed audio bit stream to generate a decoded audio signal and a pitch-based post-filter that filters each of a plurality of segments of the decoded audio signal in a manner that is dependent upon an estimated pitch period associated therewith to undo at least part of a signal-shaping effect of the pitch-based pre-filter.

A further method for enhancing the quality of an audio signal produced by an audio codec is also described herein. In accordance with the method, a compressed audio bit stream is received. The compressed audio bit stream is generated by a system that includes a pitch-based pre-filter that filters each of a plurality of segments of an input audio signal in a manner that is dependent upon an estimated pitch period associated therewith to produce a filtered audio signal and an audio encoder that encodes the filtered audio signal to generate the compressed audio bit stream. The compressed audio bit stream is then decoded in an audio decoder to generate a decoded audio signal. Each of a plurality of segments of the decoded audio signal is then filtered by a pitch-based post-filter in a manner that is dependent upon an estimated pitch period associated therewith to produce an output audio signal, wherein the filtering operates to undo at least part of a signal-shaping effect of the pitch-based pre-filter.

A method for avoiding frame boundary discontinuities when performing pitch-based pre-filtering and pitch-based post-filtering of an audio signal is also described herein. In accordance with the method, a first set of filter parameters associated with a previously-received frame of the audio signal is obtained, wherein at least one parameter in the first set of filter parameters is determined based on an estimated pitch period associated with the previously-received frame. A second set of filter parameters associated with a current frame of the audio signal is also obtained, wherein at least one parameter in the second set of filter parameters is determined based on an estimated pitch period associated with the current frame. Then, for each of a predetermined number of samples at a beginning of the current frame, an operation is consecutively performed that effectively calculates and overlap adds a first filtered audio signal sample that corresponds to the sample of the current frame and is obtained using the first set of filter parameters and a second filtered audio signal sample that corresponds to the sample of the current frame and is obtained using the second set of filter parameters, thereby obtaining a corresponding sample of a filter output signal.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS/FIGURES

The accompanying drawings, which are incorporated herein and form part of the specification, illustrate the present invention and, together with the description, further serve to explain the principles of the invention and to enable a person skilled in the relevant art(s) to make and use the invention.

Figure 1:
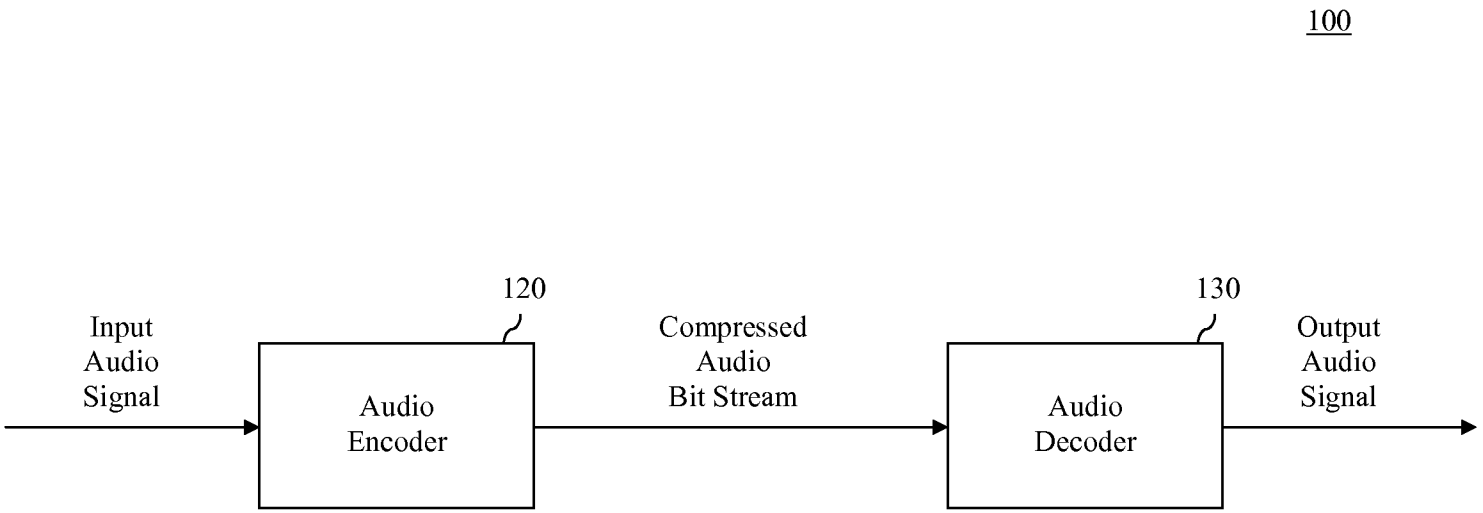
FIG. 1 (PRIOR ART)
FIG. 1 is a block diagram of a conventional audio codec system that may benefit from systems and methods described herein.

The features and advantages of the present invention will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION OF THE INVENTION

A. Introduction

The following detailed description of the present invention refers to the accompanying drawings that illustrate exemplary embodiments consistent with this invention. Other embodiments are possible, and modifications may be made to the embodiments within the spirit and scope of the present invention. Therefore, the following detailed description is not meant to limit the invention. Rather, the scope of the invention is defined by the appended claims.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to implement such feature, structure, or characteristic in connection with other embodiments whether or not explicitly described.

Systems and methods are described herein for enhancing the output audio quality of audio codecs that cannot effectively exploit pitch redundancy in an input audio signal to reduce distortion when such signal exhibits significant pitch periodicity. Examples of audio codecs that can benefit from the systems and methods described herein include low-delay transform audio codecs such as CELT and HF64. However, an audio codec does not have to be a low-delay audio codec or a transform audio codec to benefit from the systems and methods described herein. For example, the systems and methods described herein may potentially be used to enhance the output audio quality of any audio codec that does not explicitly exploit the inherent near-periodicity in some of its input signals to reduce coding distortion. In accordance with certain embodiments, the systems and methods described herein can be used in conjunction with an audio codec without increasing coding delay and with only a slight increase in the encoding bit-rate and codec complexity.

As used herein, the term "audio codec" is intended to encompass codecs designed for speech, codecs designed for music, and codecs designed for both speech and music.

As will be described in more detail herein, a system in accordance with an embodiment includes two parts: a pitch-based pre-filter and a corresponding pitch-based post-filter. The pitch-based pre-filter comprises a pre-processing technique that is applied to the input audio signal before the input audio signal is passed to the audio encoder. The pitch-based pre-filter adaptively boosts the frequency components in the spectral valleys between pitch harmonics when the input audio signal exhibits significant pitch periodicity. The effect is essentially adaptive comb filtering. The pre-filtered version of the input audio signal is then encoded by an audio encoder and decoded by an audio decoder as usual. The decoded audio signal is then passed through a corresponding pitch-based post-filter, which is a post-processing technique and in the ideal case is an exact inverse filter of the pitch-based pre-filter for that frame of the audio signal. Thus, the pitch-based post-filter attenuates the inter-harmonic spectral valleys. In an alternate embodiment, the pitch-based pre-filter adaptively suppresses pitch harmonic peaks in the frequency domain when the input signal exhibits significant pitch periodicity and the pitch-based post-filter boosts the pitch harmonic peaks in the frequency domain when the decoded audio signal exhibits significant pitch periodicity.

Depending upon the implementation, the pitch-based pre-filter and the pitch-based post-filter can be either "forward adaptive" or "backward adaptive." In the use case of a forward-adaptive pitch-based pre-filter and post-filter, the pitch period (i.e. the period, or the duration of the pitch cycle, of the periodic or nearly periodic input audio signal) and the coefficient(s) of the pitch-based pre-filter are estimated for each frame (or "block") of input audio signal samples. The pitch period and the pitch-based pre-filter coefficients are collectively called the "pitch parameters." Such pitch parameters for each frame are quantized and then transmitted along with the compressed audio bit stream of the audio codec to the receiver side. At the receiver side, the pitch parameters of each frame are decoded and then used in the pitch-based post-filter for that frame.

In the alternative use case of backward adaptive pitch-based pre-filter and post-filter, the pitch parameters for the current frame are obtained by analyzing the decoded audio signal of previous frames. Since the decoded audio signal is available on the transmitter side as well as the receiver side, such backward-adapted pitch parameters do not need to be quantized and transmitted.

Although the foregoing describes the use of forward adaptive and backward adaptive approaches in the context of a transmitter-receiver application, it is noted that embodiments described herein are not limited to transmitter-receiver applications. For example, embodiments described herein may also be used in the context of data storage applications in which audio signals are encoded and stored and then subsequently retrieved from storage and decoded.

If the input audio signal only has pitch harmonic peaks in certain frequency bands and not the entire passband (typically in the lower frequencies), an embodiment described herein also allows the pitch-based pre-filter and post-filter to boost and attenuate the inter-harmonic spectral valleys only in those frequency bands where there are pitch harmonic peaks. This can be achieved in two different ways. First, the pitch-based pre-filter and post-filter can each have multiple coefficients which are chosen to shape the frequency response such that the comb filtering effect, or the level difference between the peaks and valleys of the filter frequency response, is reduced toward zero for the frequency bands that do not have clearly defined pitch harmonic peaks. The second approach is to split the input or decoded audio signal into multiple frequency bands and apply the pitch-based pre-filter and pitch-based post-filter respectively only to the frequency bands with clear pitch harmonic peaks.

Simulation results showed that when used with an audio codec or speech codec that does not effectively exploit pitch redundancy, a pitch-based pre-filter and post-filter in accordance with an embodiment of the present invention can significantly improve the output audio quality by effectively shaping the spectrum of the coding noise so that the coding noise is attenuated in the spectral valley regions when compared with the case when the same audio codec or speech codec is used by itself without a pitch-based pre-filter and post-filter in accordance with an embodiment of the present invention.

B. Example Conventional Audio Codec System

FIG. 1 is a block diagram of a conventional audio codec system 100 that may benefit from systems and methods described herein. As shown in FIG. 1, audio codec system 100 includes an audio encoder 120 and an audio decoder 130.

Audio encoder 120 encodes an input audio signal to produce a compressed audio bit stream and audio decoder 130 decodes the compressed audio bit stream to produce an output audio signal. In many conventional audio codec systems, the input audio signal is in the digital domain, is sampled at 44.1 kHz or 48 kHz, and can be mono, stereo, or multi-channel (such as 5.1 channels). The input audio signal can, of course, be sampled at other sampling rates such as 96, 32, 24, 16, or 8 kHz, to name just a few popular ones.

In one particular implementation, audio codec system 100 utilizes a transform coding technique to compress the input audio signal. Accordingly, audio encoder 120 may process the input audio signal on a block-by-block or frame-by-frame basis. For example, audio encoder 120 may process the input audio signal on a frame-by-frame basis, wherein each frame contains audio samples corresponding to a frame size in the range of 2.5 ms to 40 ms. Audio encoder 120 transforms time-domain audio signal samples to frequency-domain transform coefficients. These frequency-domain transform coefficients are then quantized and encoded, or compressed, and the corresponding bit stream for the compressed audio signal is then either transmitted to audio decoder 130 directly or stored in a storage medium for later retrieval by audio decoder 130.

Audio decoder 130 decodes the compressed audio bit stream to recover the quantized transform coefficients and then applies an inverse transform to convert the quantized transform coefficients back to time-domain audio signal samples. Audio decoder 130 may also perform an overlap-add operation to smooth out time-domain waveform discontinuities at frame boundaries. The resulting time-domain audio signal is the quantized, or decoded, output audio signal, as shown in FIG. 1.

Many audio signals have a nearly periodic time-domain waveform, at least locally in a scale of tens or sometimes even hundreds of milliseconds. Such audio signals include steady-state voiced segments in the vowels of speech signals and many single-voice solo instrument music signals. "Single-voice" here means that the music instrument can only play a single musical note at a time. Examples include brass and woodwind instruments such as the trumpet, saxophone, clarinet, flute, etc. When the audio signal waveform is nearly periodic, the human auditory system tends to be more sensitive in picking up even small coding distortions.

As mentioned in the Background section above, if a transform audio codec is designed to achieve a low coding delay, it may be required to use a small transform window size, such as a window size below 10 ms. However, such a small transform window size is insufficient to resolve the pitch harmonics of many of the nearly periodic speech or audio signals. As a result, the inherent signal redundancy in the nearly periodic signal cannot be effectively exploited by such low-delay transform audio codecs. This fact, coupled with the fact that the human auditory system tends to be more sensitive in picking up small coding distortion during periodic or nearly periodic audio signal segments, make the coding distortion of such low-delay transform audio codecs substantially more audible than in other non-periodic audio signal segments.

Increasing the transform window size will enable the transform audio codecs to better exploit the pitch redundancy in the nearly periodic speech or music signals, but then the attractive low delay attribute will be lost. Furthermore, the codec complexity also tends to increase due to the larger transform window size. Systems and methods described herein employ low-complexity time-domain adaptive comb filtering techniques to enhance the output audio quality of audio codecs (such as audio codec 100), without increasing the coding delay, when encoding a periodic or nearly periodic signal.

Examples of low-delay transform-coding-based audio codecs that can benefit from the systems and methods described herein include CELT and HF64, which were discussed in the Background section above. Such audio codecs do not explicitly exploit pitch periodicity in an input audio signal. However, an audio codec does not have to be a low-delay audio codec or a transform audio codec to benefit from the systems and methods described herein. For example, the systems and methods described herein may potentially enhance the output audio quality of any audio codec that does not explicitly exploit the inherent near-periodicity in some of its input signals to reduce coding distortion. Specifically, audio codecs that use Sub-Band Coding (SBC) or predictive coding or a combination of these two coding techniques without explicitly exploiting the pitch redundancy can potentially benefit from the systems and methods described herein.

Figure 2:
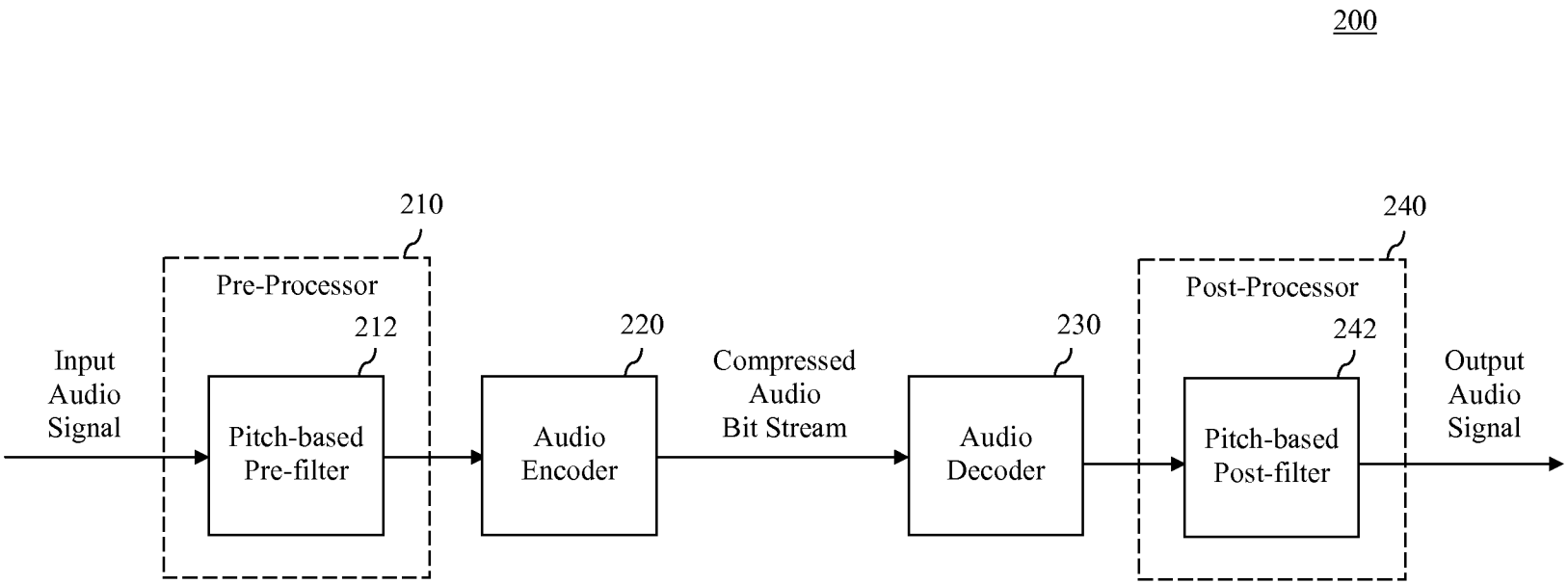
FIG. 2 is a block diagram of a system that performs pitch-based pre-filtering and post-filtering to enhance the performance of an audio codec in accordance with an embodiment.

C. Example Systems and Methods Employing Pitch-Based Pre-Filtering and Post-Filtering FIG. 2 is a block diagram of a system 200 that performs pitch-based pre-filtering and post-filtering to enhance the performance of an audio codec in accordance with an embodiment. As shown in FIG. 2, system 200 includes an audio encoder 220 and an audio decoder 230. Audio encoder 220 and audio decoder 230 may together constitute a conventional audio codec. For example, audio encoder 220 and audio decoder 230 may be functionally equivalent to audio encoder 120 and audio decoder 130, respectively, as described above in reference to FIG. 1. As further shown in FIG. 2, system 200 includes a pre-processor 210 that includes a pitch-based pre-filter 212 and a post-processor 240 that includes a pitch-based post-filter 242.

Pre-processor 210 is configured to apply pitch-based pre-filter 212 to an input audio signal before such signal is received by audio encoder 220. The purpose of pitch-based pre-filter 212 is to suppress pitch harmonic peaks in the frequency domain, or equivalently, to boost spectral valleys between pitch harmonics.

Pitch-based pre-filter 212 can take several possible forms. In one embodiment, pitch-based pre-filter 212 is implemented as a simple all-zero Finite Impulse Response (FIR) filter with a single filter tap at a bulk delay of the pitch period. More specifically, let b denote the filter tap weight and let p denote the pitch period in samples, where the pitch period is the time period by which the nearly periodic input audio signal repeats its waveform approximately. Then, the relationship between an input signal sample s(n) and output signal sample d(n) at time index n is defined by the following difference equation.

$$d(n)=s(n)-b\,s(n-p) \qquad \text{(Eq. 1)}$$

Such an all-zero FIR filter has a transfer function of $$H_{pre}(z)=\frac{D(z)}{S(z)}=1-bz^{-p}. \qquad \text{(Eq. 2)}$$

Figure 3:
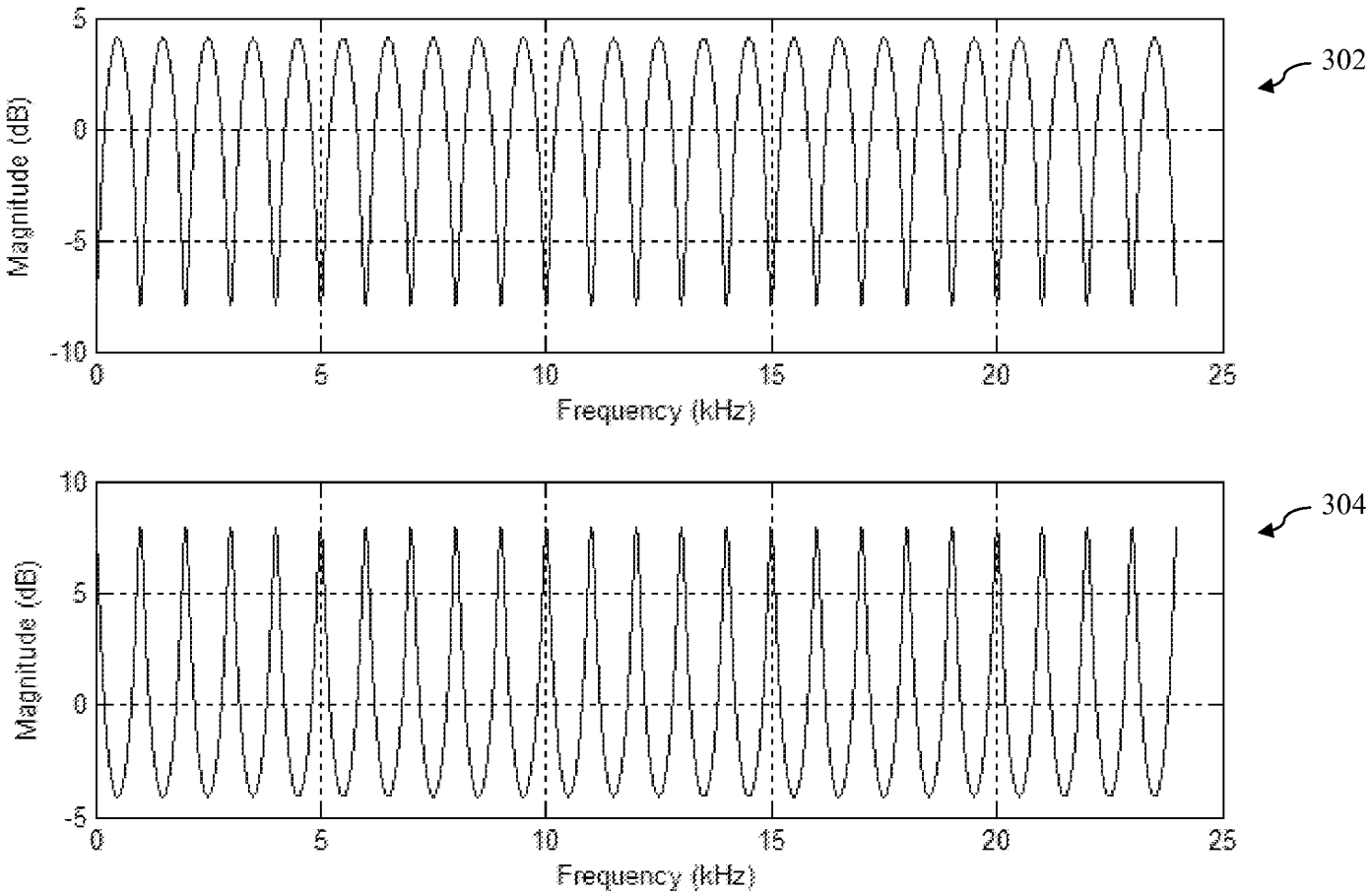
FIG. 3 depicts plots that show the frequency responses of an example all-zero pitch-based pre-filter and an inverse all-pole pitch-based post-filter, respectively, in accordance with an embodiment.

In one implementation that utilizes such an all-zero FIR filter, the filter tap weight is chosen to be $0 \le b < 1$, with $b=0$ when there is not sufficient periodicity detected in the input audio signal. The more periodic the input audio signal, the closer b is to 1. The frequency response of such a filter H(z) has equally-spaced downward spikes located at the harmonic frequencies of the pitch frequency ($F_s/p$) Hz, where $F_s$ is the sampling rate of the input audio signal in Hz. Such a frequency response looks somewhat like a comb, thus the name comb filter. A top plot 302 of FIG. 3 shows the frequency response of an example of such an all-zero pitch-based pre-filter, where the filter tap weight is b=0.6, the sampling rate is $F_s$=48 kHz, and the pitch period is p=48 samples=1 ms, which corresponds to a pitch frequency of 1 kHz. It can be seen from this frequency response that the downward spikes are equally spaced and are located at the pitch harmonic frequencies, i.e., the integer multiples of the pitch frequency 1 kHz.

Post-processor 240 is configured to apply pitch-based post-filter 242 to an audio signal output by audio decoder 230. The purpose of pitch-based post-filter 242 is to reverse or undo at least a portion of a signal-shaping effect of pitch-based pre-filter 212 on the output audio signal. That is to say, in an embodiment in which pitch-based pre-filter 212 suppresses pitch harmonic peaks in the frequency domain, pitch-based post-filter 212 operates to boost such pitch harmonic peaks. Furthermore, in an embodiment in which pitch-based pre-filter 212 boosts spectral valleys between pitch harmonics, pitch-based post-filter 242 operates to attenuate the inter-harmonic spectral valleys.

In one embodiment, pitch-based post-filter 242 is the exact inverse filter of pitch-based pre-filter 212. For example, assume that pitch-based pre-filter 212 is the simple all-zero FIR discussed above in reference to Equations 1 and 2. Furthermore, denote the input signal to pitch-based post-filter 242 as $\tilde{d}(n)$ and the output signal as $\tilde{s}(n)$ at time index n. Then the input-output relationship of pitch-based post-filter 242 is given by $$\tilde{s}(n)=\tilde{d}(n)+b\tilde{s}(n-p). \quad \text{(Eq. 3)}$$

Such a pitch-based post-filter has a transfer function of $$H_{post}(z)=\frac{\tilde{S}(z)}{\tilde{D}(z)}=\frac{1}{1-bz^{-p}}. \quad \text{(Eq. 4)}$$

This all-pole filter has a frequency response that is a mirror image of the horizontal axis, with upward spikes located at the harmonic frequencies of the pitch frequency ($F_s/p$) Hz. Like the simple all-zero FIR filter discussed above, this filter also has a frequency response that looks somewhat like a comb. Accordingly, this filter may also be considered a comb filter. A bottom plot 304 of FIG. 3 shows the frequency response of such a pitch-based post-filter, which is an exact inverse filter of the pitch-based pre-filter whose frequency response is shown in top plot 302 of FIG. 3.

It should be noted that the all-zero FIR pitch-based pre-filter and the all-pole pitch-based post-filter described above are presented by way of example only and are not intended to be limiting. In fact, a variety of other forms of pitch-based pre-filter and post-filter can be used. For example, one can use an all-pole pitch-based pre-filter in the form of $$H_{pre}(z)=\frac{1}{1+az^{-p}} \quad \text{(Eq. 5)}$$

and a corresponding all-zero pitch-based post-filter in the form of $$H_{post}(z)=1+az^{-p}. \quad \text{(Eq. 6)}$$

Figure 4:
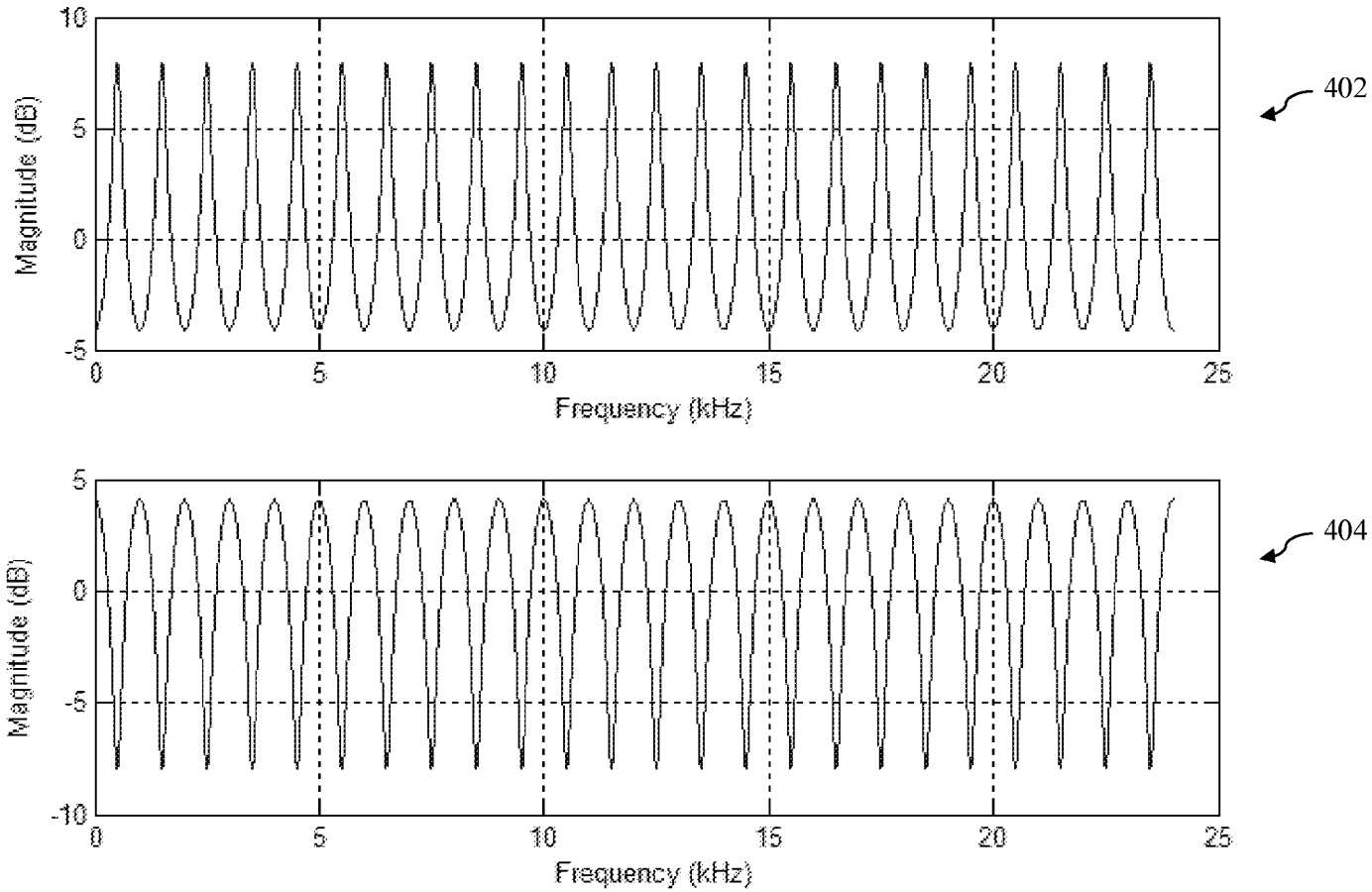
FIG. 4 depicts plots that show the frequency responses of an example all-pole pitch-based pre-filter and an inverse all-zero pitch-based post-filter, respectively, in accordance with an embodiment.
Figure 5:
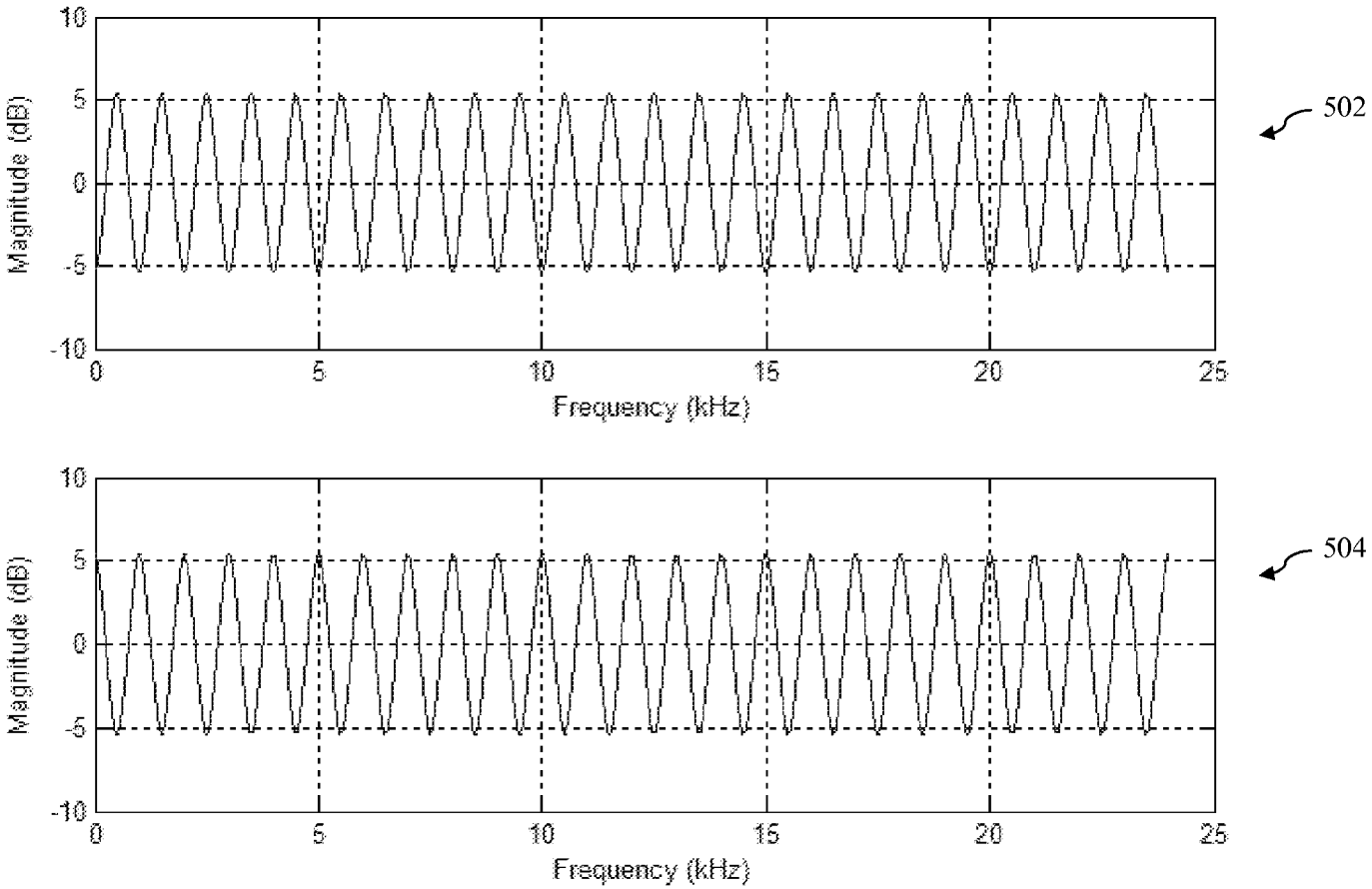
FIG. 5 depicts plots that show the frequency responses of an example pole-zero pitch-based pre-filter and an inverse pole-zero pitch-based post-filter, respectively, in accordance with an embodiment.

A top plot 402 and a bottom plot 404 of FIG. 4 show the frequency responses of such an all-pole pitch-based pre-filter and all-zero pitch-based post-filter, respectively, again with a=0.6, $F_s$=48 kHz, and p=48 samples. Furthermore, one can even use pole-zero filters for both the pitch-based pre-filter and the pitch-based post-filter, in the forms of $$H_{pre}(z)=\frac{1-bz^{-p}}{1+az^{-p}} \quad \text{(Eq. 7)}$$

and $$H_{post}(z)=\frac{1+az^{-p}}{1-bz^{-p}}, \quad \text{(Eq. 8)}$$

respectively. Pole-zero filters of the type represented by Equations 7 and 8 allow for increased control of the shape of the frequency response around each pitch harmonic, although at a cost of more computational complexity. A top plot 502 and a bottom plot 504 of FIG. 5 show the frequency responses of such a pole-zero pitch-based pre-filter and a pole-zero pitch-based post-filter, respectively, again with $F_s$=48 kHz and p=48 samples, but with a=b=0.3.

To implement pitch-based pre-filter 212 and pitch-based post-filter 242 in a manner that involves relatively low computational complexity, the example filters described above in Equations 2 and 4 may advantageously be used (i.e., where $H_{pre}(z)=1-b\,z^{-p}$ and $$H_{post}(z)=\frac{1}{1-bz^{-p}}\Big).$$

Additional details concerning such an implementation will now be provided. However, as noted above, embodiments of the present invention can use various other pitch-based pre-filter and post-filter forms, including but not limited to the two other forms mentioned above or certain multi-tap filters to be discussed below.

In accordance with certain embodiments, each of pitch-based pre-filter 212 and pitch-based post-filter 242 does not have a unit gain. In the example embodiment in which $H_{pre}(z)=1-b\,z^{-p}$ and $$H_{post}(z)=\frac{1}{1-bz^{-p}},$$

pitch-based pre-filter 212 tends to reduce the signal magnitude by a certain factor while pitch-based post-filter 242 tends to increase the signal magnitude by the same factor, so that the net effect of the two cancel out each other. This will generally not present a problem so long as such signal level change is taken into account in fixed-point implementations.

If for some reason it is desired to keep the filter output signal at roughly the same signal level as the filter input signal, then the output signal of pitch-based pre-filter 212 having the form $H_{pre}(z)=1-b\,z^{-p}$ can be multiplied by a factor of $$\frac{1}{1-b}$$

assuming b is significantly less than 1, and the output signal of pitch-based post-filter 242 having the form $$H_{post}(z)=\frac{1}{1-bz^{-p}}$$

can be multiplied by a factor of (1−b). If the filter tap b is very close to 1 but less than 1, these two scaling factors $$\frac{1}{1-b}$$

and (1−b) can become quite large and very close to zero, respectively, and are generally less reliable as scaling factors for maintaining signal levels. In this case, it may be preferable to use a scaling factor of $$\frac{1}{1-b+\delta}$$

for pitch-based pre-filter 212 and a scaling factor of (1−b+δ) for pitch-based post-filter 242, where δ is a small constant, such as 0.05.

It should be noted that both the pitch period p and the filter tap b are time-varying rather than time-invariant since the input audio signal (which may comprise, for example, speech and music signals) generally changes with time; therefore, pitch-based pre-filter 212 and pitch-based post-filter 242 are not linear time-invariant (LTI) systems. As a result, strictly speaking the two transfer functions above cannot be used to cancel each other out to achieve an identity system. However, even in time-varying linear systems, the difference equation approach is still valid. Such an approach can be used to prove that the cascade of pitch-based pre-filter 212 and pitch-based post-filter 242 as defined above by the two difference equations (i.e., Equations 1 and 3) will provide the so-called "perfect reconstruction" in the absence of the quantization effect produced by audio encoder 220 and audio decoder 230.

It is noted that if there is no quantization applied on output signal d(n) of pitch-based pre-filter 212, then $\tilde{d}(n)=d(n)$, and thus from the two difference equations represented by Equations 1 and 3 above, it follows that $$\tilde{s}(n)=d(n)+b\tilde{s}(n-p)=s(n)-b\,s(n-p)+b\tilde{s}(n-p). \quad \text{(Eq. 9)}$$

In reality, both the pitch period p and the filter tap b are functions of time and the set of {p, b} used by pitch-based post-filter 242 can potentially be different from the set of {p, b} used by pitch-based pre-filter 212 in general. However, by ensuring that the set of {p, b} used by pitch-based pre-filter 212 and pitch-based post-filter 242 is identical, and by ensuring that the signal arrays {s(n)} and {$\tilde{s}'$(n)} start with the same initial condition, the second and the third term on the right side of the last equal sign in the equation above will exactly cancel each other out, resulting in $\tilde{s}(n)=s(n)$, that is, perfect reconstruction.

Of course, with the quantization effect introduced by audio encoder 220 and audio decoder 230, such perfect reconstruction property is lost. However, if the quantization error is relatively small, i.e., the signal-to-coding-noise ratio is reasonably high, then the output signal of pitch-based post-filter 242 will still be reasonably close to the input signal of pitch-based pre-filter 212. In this case, it can be shown that the effect of adding pitch-based pre-filter 212 and pitch-based post-filter 242 is to shape the spectrum of the coding noise so the final noise spectral shape at the output of pitch-based post-filter 242 will have more attenuation in inter-harmonic spectral valleys than the noise spectral shape that will otherwise be obtained without pitch-based pre-filter 212 and pitch-based post-filter 242.

When the input audio signal is periodic or nearly periodic and the encoding bit-rate of the audio codec is not sufficiently high, a large portion of the perceived coding noise comes from the coding noise floor that is higher than the noise-masking threshold function in the spectral valleys between pitch harmonics. By adding pitch-based pre-filter 212 and pitch-based post-filter 242 to system 200, it was observed that the coding noise floor in spectral valleys between pitch harmonics was effectively reduced, thus making the coding noise less audible and enhancing the quality of the output audio signal.

In an embodiment, the pitch period p and the filter tap b discussed above are both updated on a frame-by-frame basis by analyzing the audio signal. Any reasonable pitch estimator can be used to perform this function. For example, if a low-complexity pitch estimator is desired, one can use the pitch estimator described in any of the following: U.S. Pat. No. 7,236,927 to Chen, entitled "Pitch Extraction Methods and Systems for Speech Coding Using Interpolation Techniques" and issued on Jun. 26, 2007; U.S. Pat. No. 7,529,661 to Chen, entitled "Pitch Extraction Methods and Systems for Speech Coding Using Quadratically-Interpolated and Filtered Peaks for Multiple Time Lag Extraction" and issued on May 5, 2009; and U.S. patent application Ser. No. 12/147,781 to Chen, entitled "Low-Complexity Frame Erasure Concealment" and filed on Jun. 27, 2008. The entirety of each of these documents is incorporated by reference herein.

In one embodiment, the filter tap b is made proportional to a parameter that measures the correlation between the adjacent pitch cycle waveforms, such as the cosine of the angle between a vector of a current frame of audio signal samples and a vector of the audio samples that are one pitch period earlier. Specifically, let L be the length of the frame and let time index n=1, 2, . . . , L correspond to the current frame. Then, the normalized correlation c, which is the cosine of the angle described above, is calculated as $$c=\frac{\sum_{n=1}^{L} s(n)s(n-p)}{\sqrt{\sum_{n=1}^{L} s^2(n)\sum_{n=1}^{L} s^2(n-p)}}. \quad \text{(Eq. 10)}$$

To reduce complexity, the foregoing normalized correlation may be approximated by the optimal tap weight of the single-tap pitch predictor, calculated as $$c\approx\beta=\frac{\sum_{n=1}^{L} s(n)s(n-p)}{\sum_{n=1}^{L} s^2(n-p)}. \quad \text{(Eq. 11)}$$

The pitch-based pre-filter and post-filter tap b can then be obtained as $$b=\begin{cases} b_{max} & \text{if } c>1 \\ b_{max}c & \text{if } T\le c<1 \\ 0 & \text{if } c<T. \end{cases} \quad \text{(Eq. 12)}$$

In accordance with certain embodiments, the value of $b_{max}$ is in the range of 0.4 to 0.9, and the value of the threshold T is around 0.6. However, it is noted that a threshold of 0 will work also.

FIG. 2 illustrates how pitch-based pre-filter 212 and pitch-based post-filter 242 are used with an audio codec containing audio encoder 220 and audio decoder 230. However, FIG. 2 does not show how the filter parameters of pitch-based pre-filter 212 and pitch-based post-filter 242 are adapted. Depending upon the implementation, two fundamentally different ways of adapting the parameters of such pitch-based filters may be used: either forward adaptive or backward adaptive.

Figure 6:
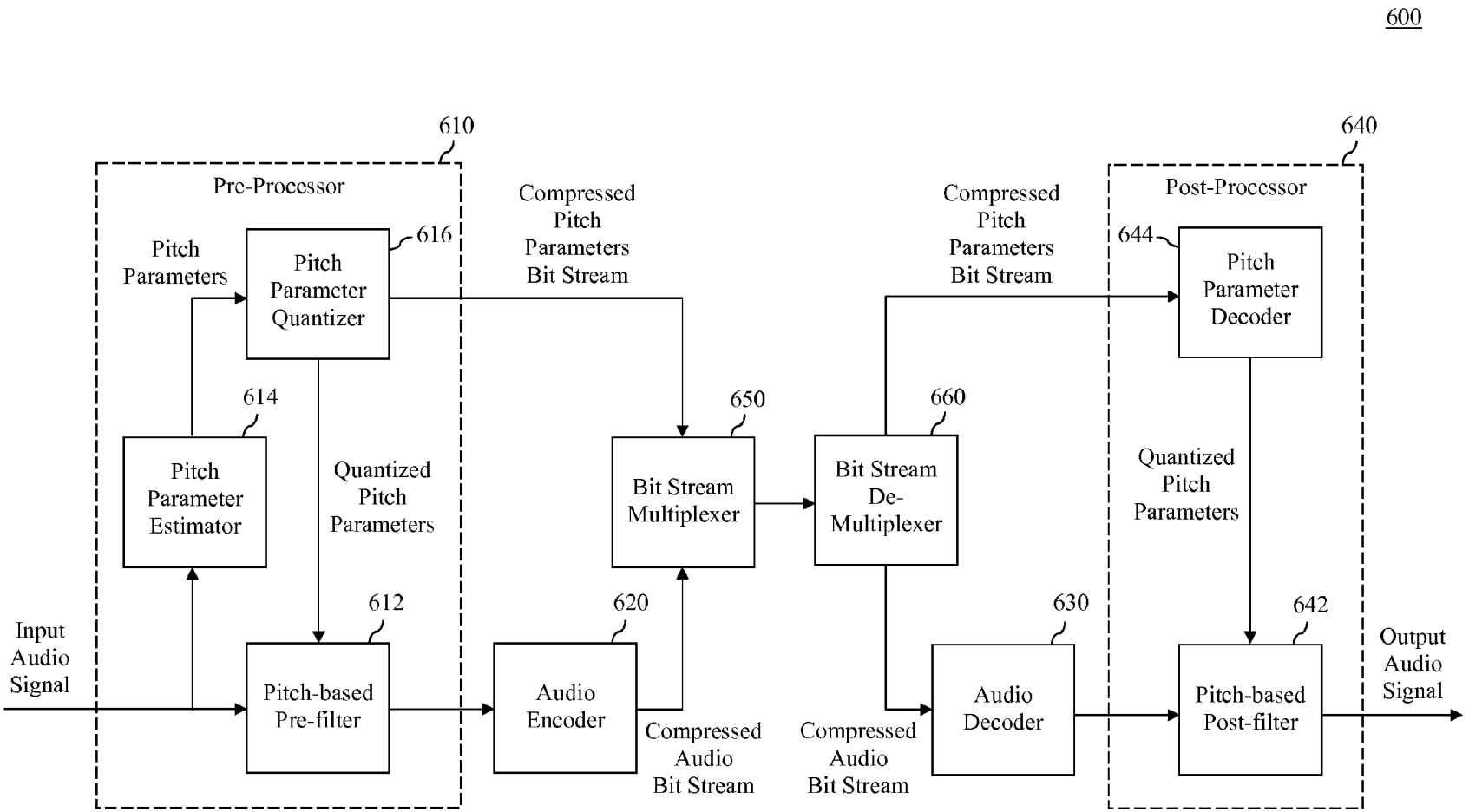
FIG. 6 is a block diagram of a system that utilizes a pitch-based pre-filter and a pitch-based post-filter to enhance the performance of an audio codec in accordance with an embodiment in which the parameters of the pitch-based pre-filter and pitch-based pre-filter are determined in a forward adaptive manner.
Figure 7:
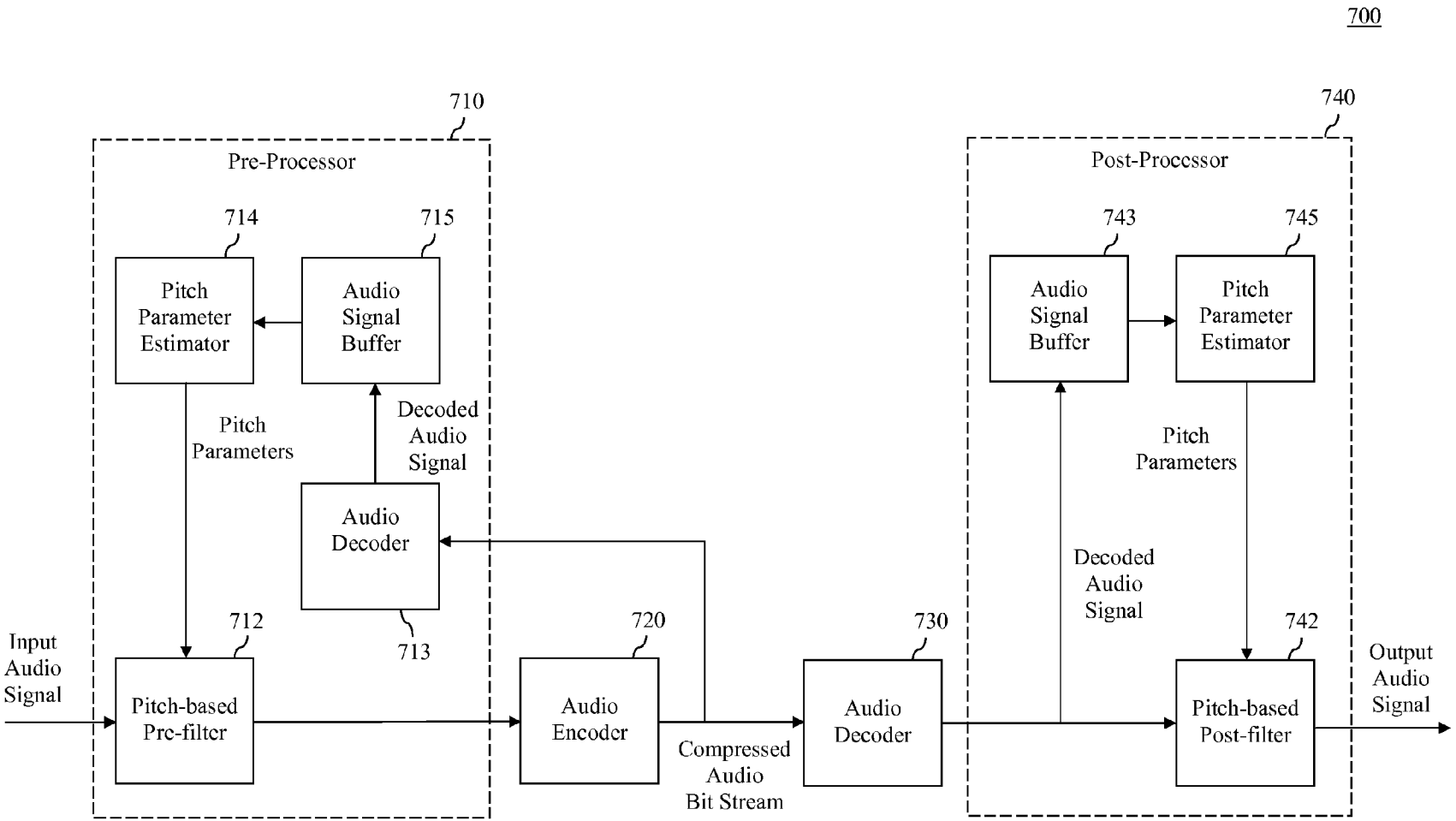
FIG. 7 is a block diagram of a system that utilizes a pitch-based pre-filter and a pitch-based post-filter to enhance the performance of an audio codec in accordance with an embodiment in which the parameters of the pitch-based pre-filter and pitch-based pre-filter are determined in a backward adaptive manner.

FIG. 6 is a block diagram of an example system 600 in which the parameters of the pitch-based pre-filter and pitch-based pre-filter are determined in a forward adaptive manner. FIG. 7 is a block diagram of an example system 700 in which the parameters of the pitch-based pre-filter and the pitch-based post-filter are determined in a backward adaptive manner.

As shown in FIG. 6, system 600 includes a pre-processor 610, an audio encoder 620, an audio decoder 630, a post-processor 640, a bit stream multiplexer 650 and a bit stream de-multiplexer 660. Pre-processor 610 includes a pitch-based pre-filter 612, a pitch parameter estimator 614 and a pitch parameter quantizer 616. Post-processor 640 includes a pitch-based post-filter 642 and a pitch parameter decoder 644.

Pitch-based pre-filter 612, audio encoder 620, audio decoder 630, and pitch-based post-filter 640 may be functionally equivalent to pitch-based pre-filter 212, audio encoder 220, audio decoder 220, and pitch-based post-filter 240, respectively, as discussed above in reference to FIG. 2. Pitch parameter estimator 614 analyzes the input audio signal to estimate the pitch period p and calculate the filter tap b using the methods described above. Pitch parameter quantizer 616 then quantizes and encodes the pitch period p and the filter tap b. (Note that the pitch period p extracted by pitch parameter estimator 614 may already be in a readily quantized format and need only be encoded into a binary code.) The quantized pitch period p and the quantized filter tap b are then used to update the parameters of the pitch-based pre-filter 612 for the current frame. The encoded bit stream for the pitch parameters is passed to bit stream multiplexer 650. Pitch-based pre-filter 612 then filters the input audio signal, resulting in a filtered audio signal, which is then encoded by audio encoder 620. Bit stream multiplexer 650 then combines the output of audio encoder 620, which is the compressed audio bit stream, with the bit stream for the pitch parameters, and sends the combined bit stream to bit stream de-multiplexer 660.

On the decoder side, bit stream de-multiplexer 660 receives the incoming combined bit stream, extracts the compressed pitch parameters bit stream and passes it to pitch parameter decoder 644. Bit stream de-multiplexer 660 also extracts the compressed audio bit stream and passes it to audio decoder 630. Pitch parameter decoder 644 decodes the compressed pitch parameters bit stream to obtain the quantized pitch parameters (quantized pitch period p and quantized filter tap b) and uses them to update the parameters of pitch-based post-filter 642. Audio decoder 630 decodes the compressed audio bit-stream into a decoded audio signal, which is then filtered by the pitch-based post-filter 642 to obtain the final output audio signal.

In accordance with certain embodiments in which the input audio signal is sampled at 48 kHz, 9 to 10 bits are used to encode the pitch period p and 2 to 3 bits are used to encode filter tap b. Thus, in accordance with such embodiments, a total of 11 to 13 bits per frame are used to encode the pitch period p and the filter tap b. With a frame size of 5 ms, or 200 frames per second, this translates to a "side information" bit-rate of about 2.2 to 2.6 kb/s. This is a fairly small additional bit-rate overhead when compared with typical stereo audio encoding bit-rate of 64 to 256 kb/s, but it can provide very significant audio quality improvement for nearly periodic speech and audio signals as was observed in simulations and listening comparisons, especially for lower-bit-rate low-delay audio codecs. If the bit error rate and the packet loss rate are very low so error propagation is not a concern, then it is possible to use differential coding, entropy coding, or a combination of the two to reduce this pitch parameter encoding bit-rate significantly to just a small fraction of the 2.2 to 2.6 kb/s bit-rate quoted above.

In the absence of channel errors, the pitch period p and the filter tap b used in pitch-based pre-filter 612 and pitch-based post-filter 642 will be identical for every frame. If the filter memory of these two filters is also initialized to the same values, system 600 would maintain the perfect reconstruction property if the audio signal was not quantized. Although audio signal quantization would break the perfect reconstruction, at least by keeping the pitch period p, the filter tap b, and the filter memory synchronized between pitch-based pre-filter 612 and pitch-based post-filter 642 as much as possible, any potential distortion due to mismatch of the filter coefficients and states should be minimized.

FIG. 4 is a block diagram of a system 700 in accordance with an alternative embodiment in which the pitch-based pre-filter and the pitch-based post-filter are backward adaptive. As shown in FIG. 7, system 700 includes a pre-processor 710, an audio encoder 720, an audio decoder 730 and a post-processor 740. Pre-processor 710 includes a pitch-based pre-filter 712, an audio decoder 713, an audio signal buffer 715 and a pitch parameter estimator 714. Post-processor 740 includes a pitch-based post-filter 742, an audio signal buffer 743 and a pitch parameter estimator 745.

Pitch-based pre-filter 712, audio encoder 720, audio decoder 730, and pitch-based post-filter 742 may be functionally equivalent to pitch-based pre-filter 212, audio encoder 220, audio decoder 220, and pitch-based post-filter 240, respectively, as discussed above in reference to FIG. 2. Audio decoder 713 decodes the compressed audio bit stream produced by audio encoder 720 to obtain the decoded audio signal, which is stored in audio signal buffer 715. Pitch parameter estimator 714 analyzes the decoded audio signal of the past few frames that is stored in audio signal buffer 715 to obtain the pitch period p and the filter tap b to update the parameters of pitch-based pre-filter 712 for the current frame.

Similarly, the decoded audio signal produced by audio decoder 730 is stored in audio signal buffer 743, and pitch parameter estimator 745 analyzes the decoded audio signal of the past few frames that is stored in audio signal buffer 743 to obtain the pitch period p and the filter tap b to update the parameters of pitch-based post-filter 742 for the current frame. Again, with proper initialization and in the absence of channel errors, the pitch period p, the filter tap b, and the filter memory should be synchronized between pitch-based pre-filter 712 and pitch-based post-filter 742, thus minimizing distortion due to mismatch of filter coefficients and states.

One advantage of the alternative embodiment shown in FIG. 7 is that it does not require the transmission of the side information for the pitch filter parameters. However, there are several disadvantages. First, since pitch parameter estimator 714 generates a pitch period and a filter tap that are one frame obsolete, the performance of pitch-based pre-filter 712 and pitch-based post-filter 742 can be expected to be somewhat worse than their forward-adaptive counterparts in FIG. 6, although for a long stretch of audio signal having a nearly constant pitch period, this method should still provide some useful audio quality enhancement. Second, the addition of audio decoder 713 on the encoder side may increase the overall system complexity significantly. Third, the pitch parameter adaptation in this backward adaptive system can potentially be sensitive to channel errors and the error propagation effect; therefore, this backward adaptive approach is probably only suitable for applications where there are little or no channel errors, such as audio storage applications.

In some nearly periodic speech or music signals, the equally spaced pitch harmonic spectral peaks are only well-defined in some parts of the frequency bands—usually in the lower frequency bands. In this case, applying a simple comb filter throughout the entire frequency range may introduce more periodicity in those frequency bands without well-defined pitch harmonics. Depending on the audio signal, such additional pitch harmonic peaks in higher frequency bands may or may not be audible. If it is determined that it may be audible, then two approaches may be used to combat this problem: (1) use a multiple-tap pitch-based pre-filter and post-filter, and (2) use a band splitter and a band combiner so that pitch-based pre-filtering and pitch-based post-filtering can be applied only to selected frequency bands.

In the first approach, those skilled in the relevant art(s) would understand that by replacing the single-tap pitch-based pre-filter and post-filter with multi-tap versions with none-zero tap weights $b_{-M}$, $b_{-M+1}$, . . . , $b_{M-1}$, $b_M$ for bulk delay values of p-M, p−M+1, . . . , p+M−1, p+M, respectively, it is possible to shape the spectral envelope, or the difference between peaks and valleys of the filter frequency response, as a function of frequency. (Here M=1 and M=2 correspond to the well-known three-tap and five-tap pitch filters, respectively.) Thus, a multi-tap pitch-based pre-filter and a multi-tap pitch-based post-filter can be used to control the degree of comb filtering as a function of frequency so that it is reduced toward zero for those higher frequencies where there are no well-defined pitch harmonic peaks.

Figure 8:
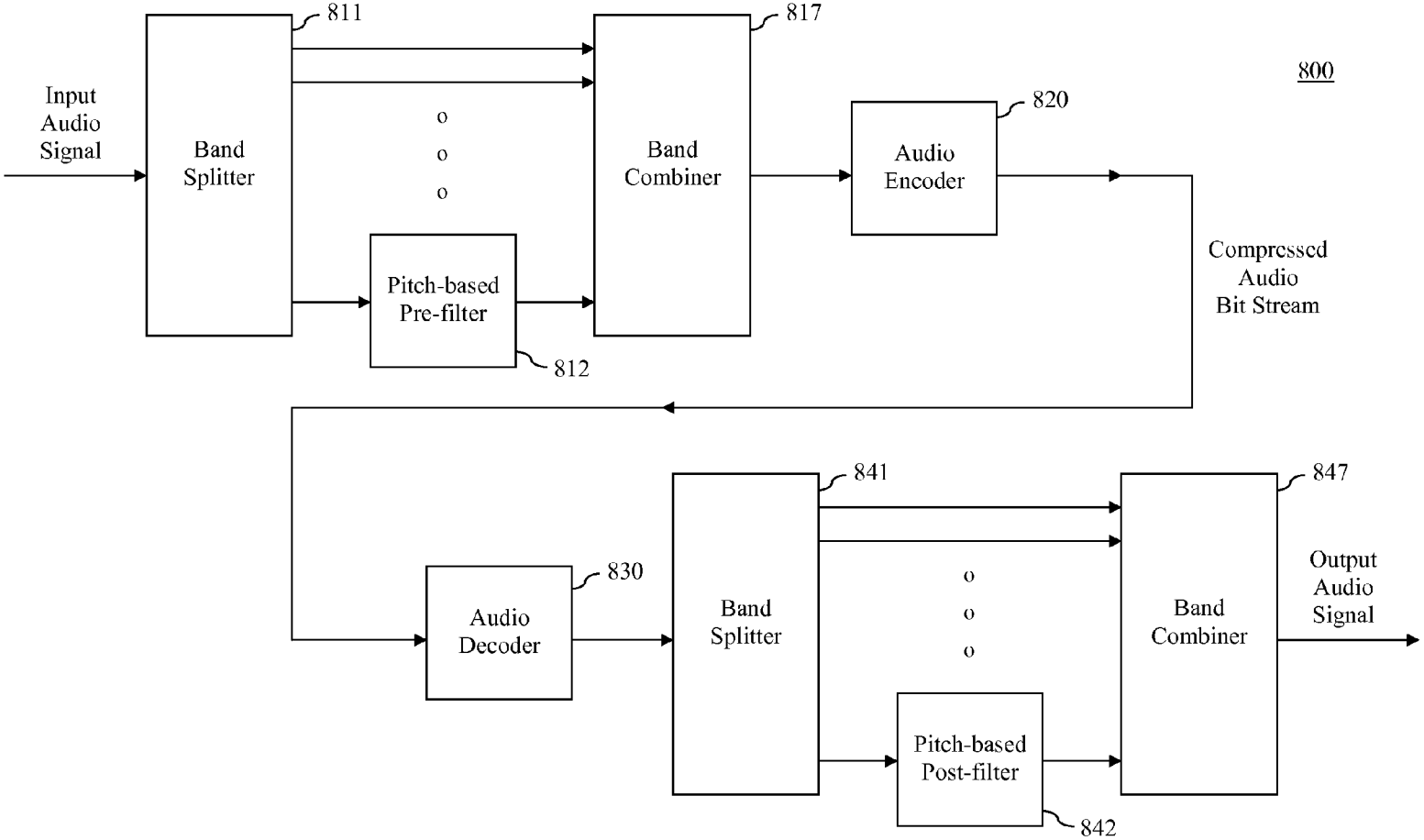
FIG. 8 is a block diagram of a system that performs pitch-based pre-filtering and post-filtering to enhance the performance of an audio codec in accordance with an embodiment in which band splitters and band combiners are used so that the pitch-based pre-filtering and pitch-based post-filtering can be applied only to selected frequency bands.

FIG. 8 is a block diagram of an example system 800 that uses the second approach. As shown in FIG. 8, a band splitter 811, such as an analysis filter bank, is used to split an input audio signal into a plurality of sub-band signals. Pitch-based pre-filter 812 is then applied only to a frequency range where there are clearly defined pitch harmonic peaks. A band combiner 817, such as a synthesis filter bank, then recombines all the sub-band signals to reconstruct a full-band audio signal that is passed to audio encoder 820 for encoding. On the decoder side, a decoded audio signal output by audio decoder 830 is split by a band splitter 841 into a plurality of sub-band signals. Pitch-based post-filter 842 is then applied only to the frequency range where there are clearly defined pitch harmonic peaks. A band combiner 847 then recombines all the sub-band signals to reconstruction a full-band output audio signal. This approach will leave those frequencies without pitch harmonics untouched.

Figure 9:
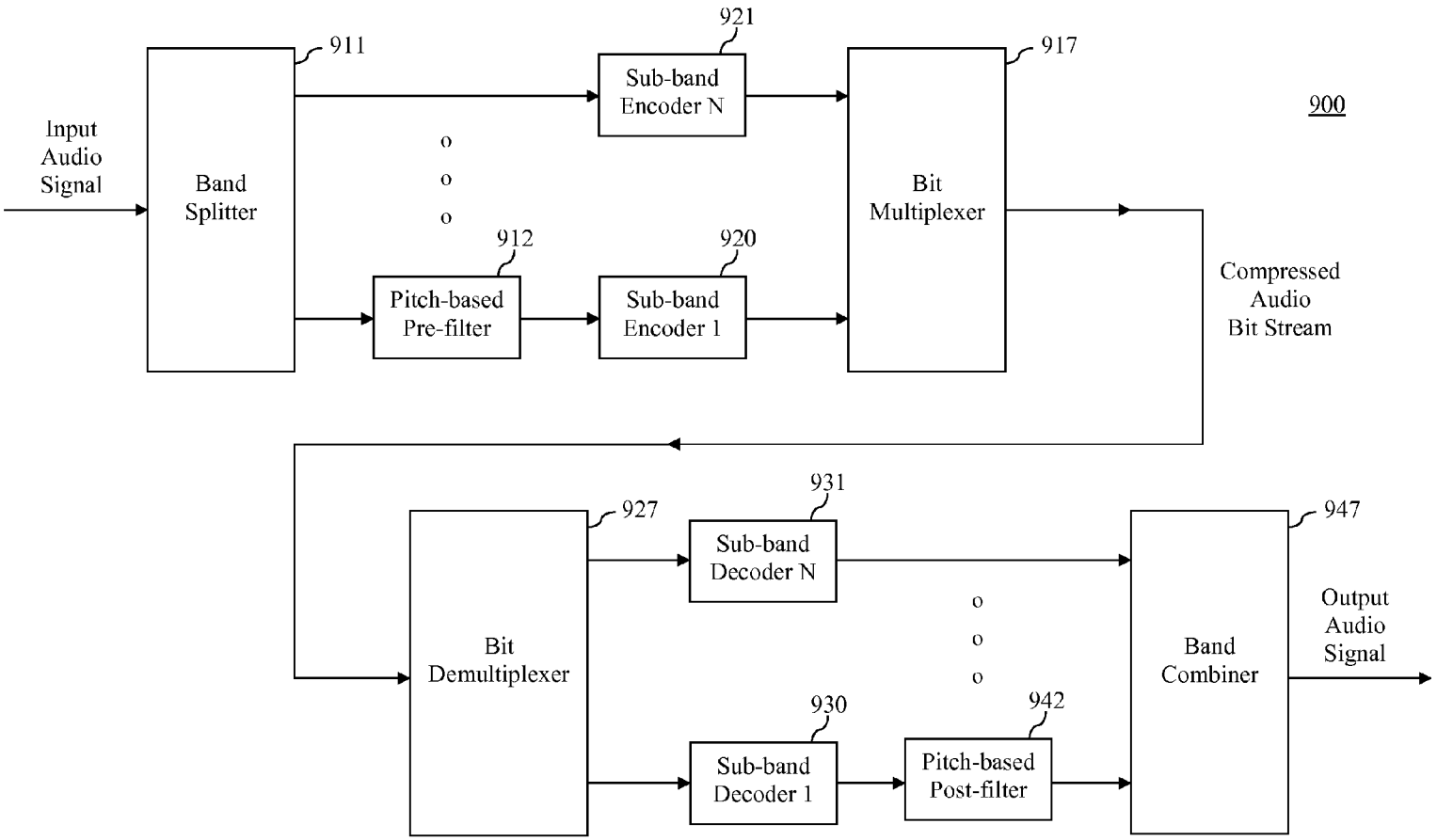
FIG. 9 is a block diagram of a system in accordance with an embodiment that implements an approach for band-selective pitch-based pre-filtering and post-filtering when applied to sub-band coding (SBC).

An alternative form of this basic band-splitting approach can achieve better computational efficiency and lower delay if audio encoder 820 and audio decoder 830 use sub-band coding (SBC) techniques. FIG. 9 is a block diagram of an example system 900 that implements such an alternative approach for band-selective pitch-based pre-filtering and post-filtering when applied to SBC. As shown in FIG. 9, system 900 includes an encoder portion that includes a band splitter 911, a pitch-based pre-filter 912, a plurality of sub-band encoders 920 and 921 and a bit multiplexer 917 and a decoder portion that includes a bit demultiplexer 927, a plurality of sub-band decoders 930 and 931, a pitch-based post-filter 942 and a band combiner 947. The encoder portion of system 900 resembles the encoder of a conventional SBC codec, except that pitch pre-filter 912 is inserted between band splitter 911 and sub-band encoder 1 (block 920). Similarly, the decoder portion of system 900 resembles the decoder of a conventional SBC codec, except that pitch post-filter 942 is inserted between sub-band decoder 1 (block 930) and band combiner 947. The net effect of inserting such pitch-based pre-filter and post-filter only for sub-band 1 is that only the frequency range in sub-band 1 will receive the adaptive comb filtering effect.

Theoretically speaking, such pitch-based filtering can be applied to more than just the first sub-band. In reality, however, the critically sub-sampled higher sub-band signals may not have pitch harmonics located at exactly the integer multiples of the fundamental pitch frequency, and this makes it difficult to apply adaptive comb filtering effectively. However, even if the pitch-based pre-filter and post-filter is only applied to the first sub-band (corresponding to the lowest frequencies), this can still achieve significant reduction of coding distortion if the SBC codec only has a few sub-bands and does not exploit pitch redundancy explicitly. For example, the SBC codec used in the Bluetooth® standard for audio transmission only uses 4 or 8 sub-bands and does not exploit pitch redundancy explicitly. When such an SBC codec is used for 48 kHz sampled audio signals, then the first sub-band will cover the frequencies below 6 kHz and 3 kHz for 4-sub-band and 8-sub-band SBC codec, respectively. The strongest pitch periodicity is usually observed in the lowest frequency range, so even selectively applying the pitch-based pre-filtering and post-filtering only to the lowest 3 or 6 kHz can still provide significant reduction of coding distortion in such an SBC codec if the encoding bit-rate is relatively low and there is significant pitch periodicity in the input audio signal.

Exemplary pitch pre-filtering and post-filtering methods for enhancing the quality of an audio signal produced by an audio codec will now be described in reference to FIGS. 10 and 11. Each of these methods may be performed by components described above in reference to FIGS. 2 and 6-8. However, persons skilled in the relevant art(s) will appreciate that the methods are not limited to those implementations.

Figure 10:
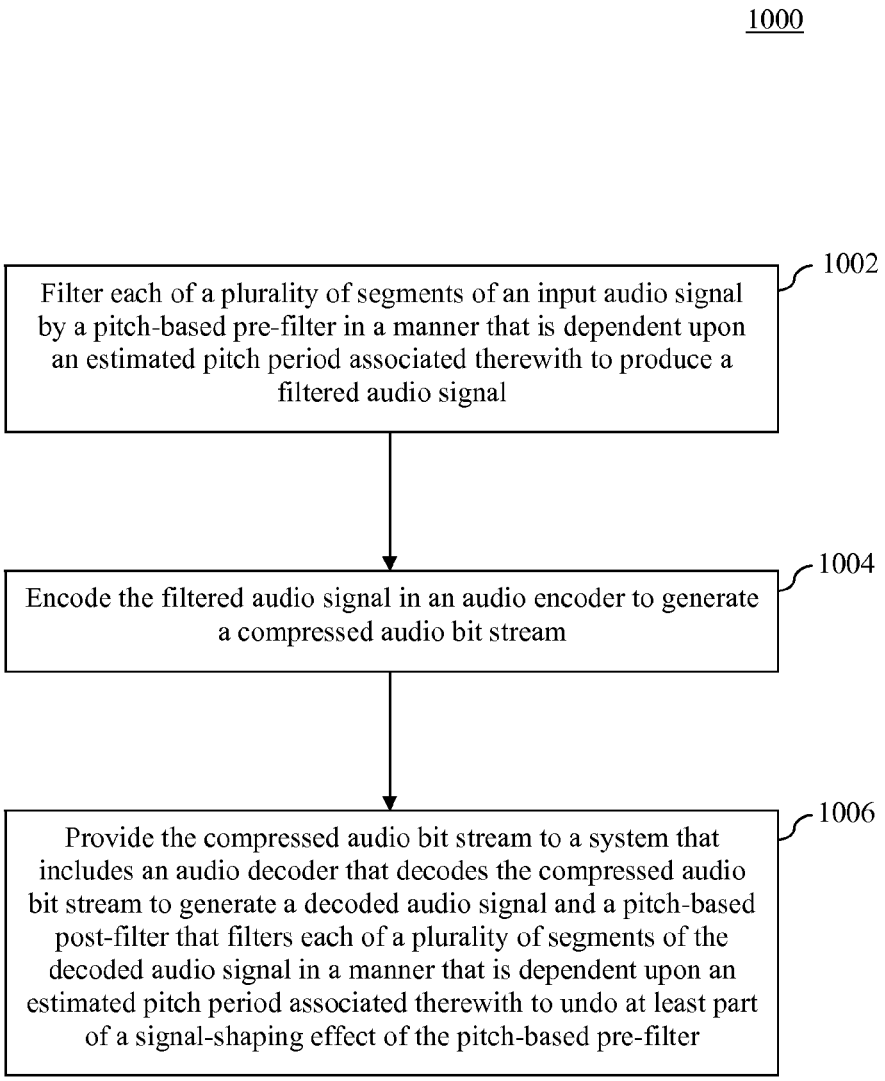
FIG. 10 depicts a flowchart of a method for enhancing the quality of an audio signal produced by an audio codec in accordance with an embodiment.

In particular, FIG. 10 depicts a flowchart 1000 of a method for enhancing the quality of an audio signal produced by an audio codec. As shown in FIG. 10, the method of flowchart 1000 begins at step 1002, in which each of a plurality of segments of an input audio signal is filtered by a pitch-based pre-filter in a manner that is dependent upon an estimated pitch period associated therewith to produce a filtered audio signal. This step may be performed, for example, by any of pitch-based pre-filter 212, pitch-based pre-filter 612, pitch-based pre-filter 712 or pitch-based pre-filter 812 as previously described.

At step 1004, the filtered audio signal produced by step 1002 is encoded in an audio encoder to generate a compressed audio bit stream. This step may be performed, for example, by any of audio encoder 220, audio encoder 620, audio encoder 720 or audio encoder 820 as previously described.

At step 1006, the compressed audio bit stream is provided to a system that includes an audio decoder that decodes the compressed audio bit stream to generate a decoded audio signal and a pitch-based post-filter that filters each of a plurality of segments of the decoded audio signal in a manner that is dependent upon an estimated pitch period associated therewith to undo at least part of a signal-shaping effect of the pitch-based pre-filter. The audio decoder and pitch-based post-filter referred to in step 1006 may comprise, for example and without limitation, audio decoder 230 and pitch-based post-filter 242, audio decoder 630 and pitch-based post-filter 642, audio decoder 730 and pitch-based post-filter 742, or audio decoder 830 and pitch-based post-filter 842, respectively.

In accordance with certain embodiments, step 1002 may comprise performing adaptive comb filtering in a manner previously described to suppress pitch harmonic peaks in the frequency domain when a segment of the input audio signal exhibits pitch periodicity. In further accordance with such embodiments, the pitch-based post-filter referred to in step 1006 may comprise a pitch-based post-filter that filters each of the plurality of segments of the decoded audio signal by performing adaptive comb filtering in a manner previously described to boost pitch harmonic peaks in the frequency domain when a segment of the decoded audio signal exhibits pitch periodicity.

In accordance with certain other embodiments, step 1002 may comprise performing adaptive comb filtering in a manner previously described to boost spectral valleys between pitch harmonics in the frequency domain when a segment of the input audio signal exhibits pitch periodicity. In further accordance with such embodiments, the pitch-based post-filter referred to in step 1006 may comprise a pitch-based post-filter that filters each of the plurality of segments of the decoded audio signal by performing adaptive comb filtering in a manner previously described to attenuate spectral valleys between pitch harmonics in the frequency domain when a segment of the decoded audio signal exhibits pitch periodicity.

Figure 11:
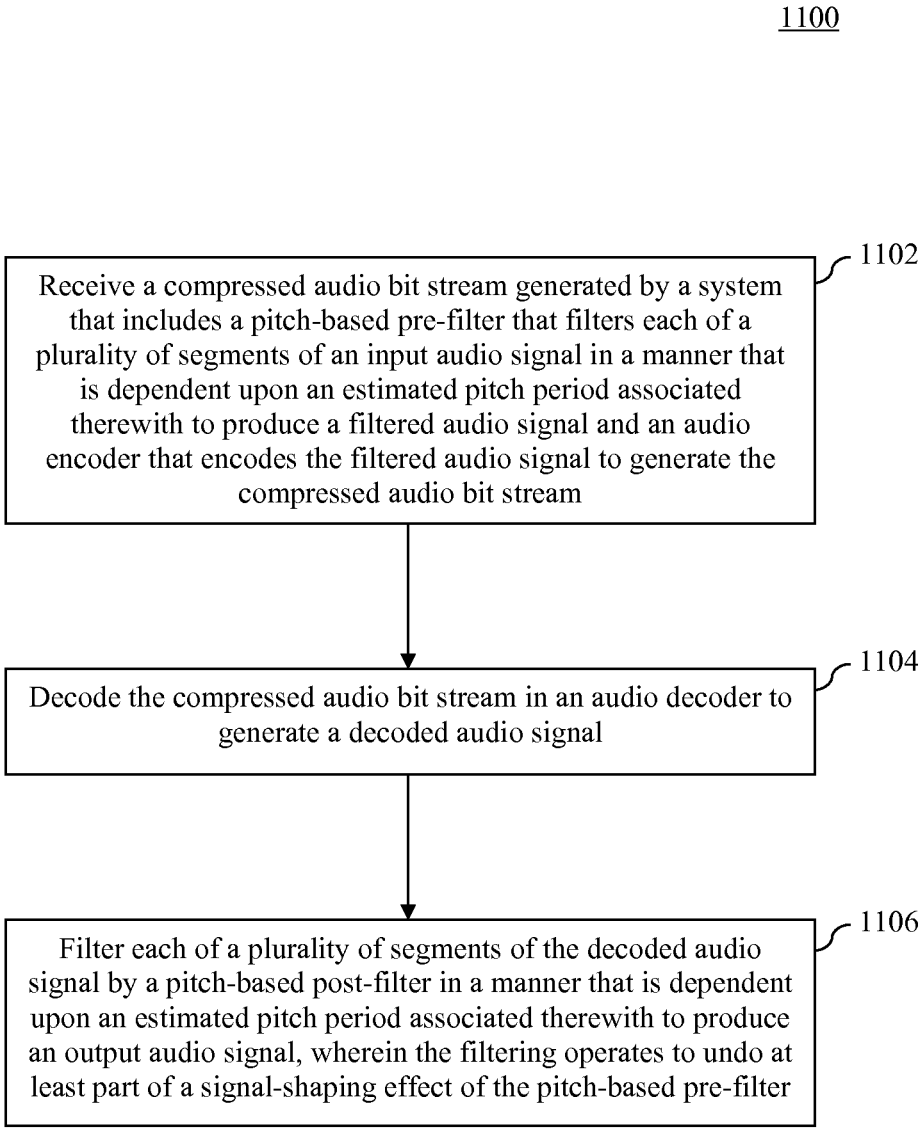
FIG. 11 depicts a flowchart of a method for enhancing the quality of an audio signal produced by an audio codec in accordance with a further embodiment.

FIG. 11 depicts a flowchart 1100 of a further method for enhancing the quality of an audio signal produced by an audio codec. As shown in FIG. 11, the method of flowchart 1100 begins at step 1102, in which a compressed audio bit stream is received. The compressed audio bit stream is generated by a system that includes a pitch-based pre-filter that filters each of a plurality of segments of an input audio signal in a manner that is dependent upon an estimated pitch period associated therewith to produce a filtered audio signal and an audio encoder that encodes the filtered audio signal to generate the compressed audio bit stream. The pitch-based pre-filter and audio encoder referred to in step 1102 may comprise, for example and without limitation, pitch-based pre-filter 212 and audio encoder 220, pitch-based pre-filter 612 and audio encoder 620, pitch-based pre-filter 712 and audio encoder 720, or pitch-based pre-filter 812 and audio encoder 820, respectively.

At step 1104, the compressed bit stream received during step 1102 is decoded in an audio decoder to generate a decoded audio signal. This step may be performed, for example, by any of audio decoder 230, audio decoder 630, audio decoder 730 or audio decoder 830 as previously described.

At step 1106, each of a plurality of segments of the decoded audio signal generated during step 1104 is filtered by a pitch-based post-filter in a manner that is dependent upon an estimated pitch period associated therewith to produce an output audio signal, wherein the filtering operates to undo at least part of a signal-shaping effect of the pitch-based pre-filter referenced in step 1102. This step may be performed, for example, by any of pitch-based post-filter 242, pitch-based post-filter 642, pitch-based post-filter 742 or pitch-based post-filter 842 as previously described.

In accordance with certain embodiments, the pitch-based pre-filter referred to in step 1102 may comprise a pitch-based pre-filter that filters each of the plurality of segments of the input audio signal by performing adaptive comb filtering in a manner previously described to suppress pitch harmonic peaks in the frequency domain when a segment of the input audio signal exhibits pitch periodicity. In further accordance with such embodiments, step 1106 may comprise performing adaptive comb filtering in a manner previously described to boost pitch harmonic peaks in the frequency domain when a segment of the decoded audio signal exhibits pitch periodicity.

In accordance with certain other embodiments, the pitch-based pre-filter referred to in step 1102 may comprise a pitch-based pre-filter that filters each of the plurality of segments of the input audio signal by performing adaptive comb filtering in a manner previously described to boost spectral valleys between pitch harmonics in the frequency domain when a segment of the input audio signal exhibits pitch periodicity. In further accordance with such embodiments, step 1106 may comprise performing adaptive comb filtering in a manner previously described to attenuate spectral valleys between pitch harmonics in the frequency domain when a segment of the decoded audio signal exhibits pitch periodicity.

D. Overlap-Add Technique in Accordance with Embodiments

One practical problem that may arise when applying a pitch-based pre-filter and pitch-based post-filter as described in the preceding section is that when the filter parameters (e.g., the pitch period p and the filter tab b described in reference to particular embodiments above) change at the frame boundary, there is often a waveform discontinuity in the output signal of such filters. This waveform discontinuity can lead to an undesired effect in the audio encoder and will introduce an audible click in the output audio signal. This problem can be avoided by applying an overlap-add method such as that described in the U.S. Pat. No. 7,353,168 to Thyssen, Lee and Chen entitled "Method and Apparatus to Eliminate Discontinuities in Adaptively Filtered Signals" and issued on Apr. 1, 2008, the entirety of which is incorporated by reference herein.

Specifically, at the beginning of the current frame and with the filter memory set at the value left after filtering the last sample of the last frame, two filtering operations are performed for the first K samples of the current frame. In accordance with certain embodiments, K is chosen to correspond to 2.5 ms or longer. The first filtering operation is performed with the filter parameters (e.g., the pitch period p and filter tap b) of the last frame, and the second filtering operation is performed with the filter parameters of the current frame. Note that both filtering operations should start with the same filter memory that was left after filtering the last sample of the last frame. A fade-out window of K samples is applied to the output signal of the first filtering operation, while a fade-in window of K samples is applied to the output signal of the second filtering operation. In one embodiment, the fade-out window comprises a downward-sloping triangular window and the fade-in window comprises an upward-sloping triangular window, although other fade-out and fade-in windows can be used. The sum of the fade-in and fade-out windows is unity at every one of the K samples.

The application of the fade-out and fade-in windows in the manner described above produces two windowed filter output signals. The two windowed filter output signals are overlapped and added together and used as the final filter output signal. It is assumed that $K \leq L$, wherein L represents the number of samples in a frame. If $K<L$, then from (K+1)-th sample to the last (L-th) sample of the current frame, only one filtering operation is performed using the filter parameters of the current frame. Such an overlap-add filtering method ensures smooth waveform transition and eliminate waveform discontinuities at frame boundaries.

An all-zero pitch-based pre-filter with overlap-add is relatively straightforward to implement. On the other hand, due to the recursive nature of all-pole filtering, an all-pole pitch-based post-filter needs to be handled with care, especially when the pitch period is smaller than the overlap-add length K. In this case, the two filtering operations should not be implemented independently of each other for the entire K samples and then windowed and overlap-added together in the manner previously described. This is because a waveform discontinuity at the beginning of the current frame resulting from such independent filtering will be repeated before the K samples of the overlap-add period is over and, therefore, the overlap-add operation will not be able to smooth out such repeated waveform discontinuities after the beginning of the current frame.

To address this issue, an embodiment effectively overlap adds the output of each of the two filtering operations on a sample-by-sample basis. As a result, the waveform discontinuity at the beginning of the frame is already smoothed out by the overlap-add operation by the time the filtering operation reaches one pitch period into the frame, so there will not be a repeated waveform discontinuity there.

Specifically, let the time index n for the current frame be from 1 to L, and let $w_i(n)$ and $w_o(n)$ be the fade-in window sample and fade-out window sample at time index n, respectively. In addition, let $p_0$ and $b_0$ be the pitch period and the filter tap of the previous frame, respectively. Then, the all-pole pitch-based post-filtering with overlap-add should be performed sample-by-sample for the first K samples of the current frame by the following pseudo-code.

```
for n from 1 to K
    calculate the pitch-based post-filter output sample as
    s̃(n) = d̃(n) + w_o(n) b_0 s̃(n − p_0) + w_i(n) b s̃(n − p)
end
```

After filtering the first K samples, if L>K, then the filtering from the (K+1)-th sample to the L-th sample is just simple all-pole filtering using the difference equation $$\tilde{s}(n)=\tilde{d}(n)+b\tilde{s}(n-p). \quad \text{(Eq. 13)}$$

In accordance with one embodiment, K is chosen to corresponding to 2.5 ms, or 120 samples at a 48 kHz sampling rate. Such an embodiment may be useful when the pitch-based pre-filtering and post-filtering is utilized in conjunction with the CELT coding mode of the IETF Opus codec, as such codec utilizes four possible frame sizes, the smallest of which is 2.5 ms.

Figure 12:
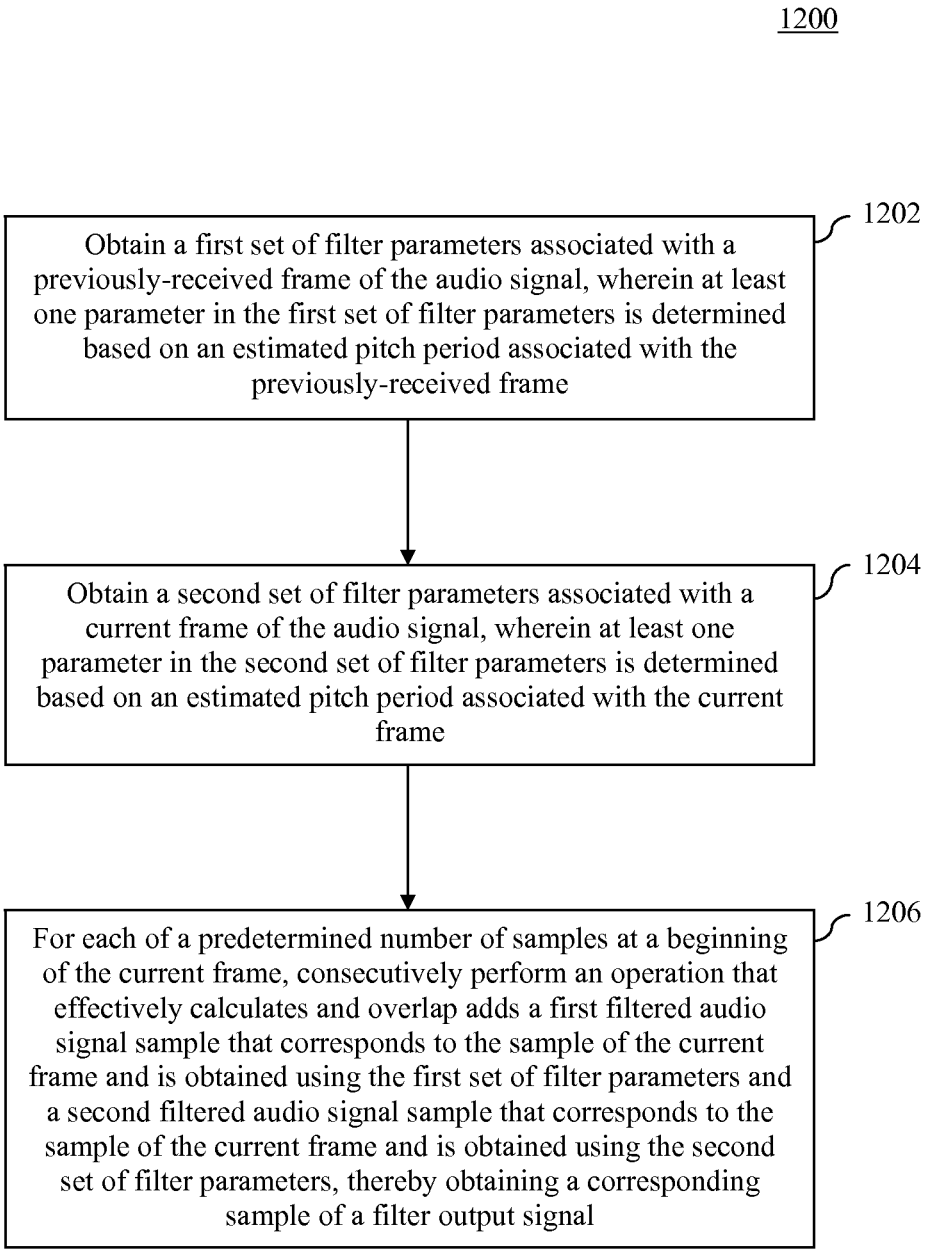
FIG. 12 depicts a flowchart of a method for performing a sample-by-sample overlap-add operation to avoid frame boundary discontinuities when performing pitch-based post-filtering of an audio signal in accordance with an embodiment.

FIG. 12 depicts a flowchart 1200 of a method for performing the foregoing sample-by-sample overlap-add operation. The method of flowchart 1200 may be performed, for example, by at least any of the pitch-based post-filters described above in reference to FIGS. 2 and 6-9. However, as will be appreciated by persons skilled in the relevant art(s), the method is not limited to those implementations.

As shown in FIG. 12, the method begins at step 1202, in which a first set of filter parameters associated with a previously-received frame of the audio signal is obtained, wherein at least one parameter in the first set of filter parameters is determined based on an estimated pitch period associated with the previously-received frame.

At step 1204, a second set of filter parameters associated with a current frame of the audio signal is obtained, wherein at least one parameter in the second set of filter parameters is determined based on an estimated pitch period associated with the current frame.

At step 1206, for each of a predetermined number of samples at a beginning of the current frame, an operation is consecutively performed that effectively calculates and overlap adds a first filtered audio signal sample that corresponds to the sample of the current frame and is obtained using the first set of filter parameters and a second filtered audio signal sample that corresponds to the sample of the current frame and is obtained using the second set of filter parameters, thereby obtaining a corresponding sample of a filter output signal.

In one embodiment, the first set of filter parameters obtained during step 1202 includes a filter tap $b_0$ and an estimated pitch period $p_0$ associated with the previously-received frame and the second set of filter parameters obtained during step 804 includes a filter tap b and an estimated pitch period $p_0$ associated with the current frame. In further accordance with such an embodiment, step 1206 may comprise performing, for consecutive values of an index n from 1 to K:

$$\tilde{s}(n)=\tilde{d}(n)+w_o(n)b_0\tilde{s}(n-p_0)+w_i(n)b\tilde{s}(n-p);$$

wherein K represents the predetermined number of samples at the beginning of the current frame, $\tilde{s}(n)$ represents an n-th sample of the filter output signal, $\tilde{d}(n)$ represents an n-th sample of the filter input signal, $w_0$ represents an n-th coefficient of a fade-out window, and $w_i$ represents an n-th coefficient of a fade-in window.

It is noted that when an overlap-add filtering approach such as that described above is used, the perfect reconstruction property for the non-overlap-add version of the simple pitch-based pre-filter 212 and pitch-based post-filter 242 as described earlier no longer holds true. In fact, it can be shown that to maintain the perfect reconstruction property, the parallel filtering and overlap-add of the two filtered output signals should be performed not for the entire all-pole pitch-based post-filter $$H_{post}(z) = \frac{1}{1 - bz^{-p}},$$

but only for the all-zero FIR filter $b\,z^{-p}$ in the feedback branch of the all-pole filter $H_{post}(z)$. For the pitch-based pre-filter $H_{pre}(z)=1-b\,z^{-p}$, applying the overlap-add filtering approach to the entire $H_{pre}(z)$ filter is mathematically equivalent to applying the overlap-add filtering approach only to the all-zero FIR filter b z p in the feed-forward branch of the all-zero filter $H_{pre}(z)$.

E. Example Processor-Based Implementation

Figure 13:
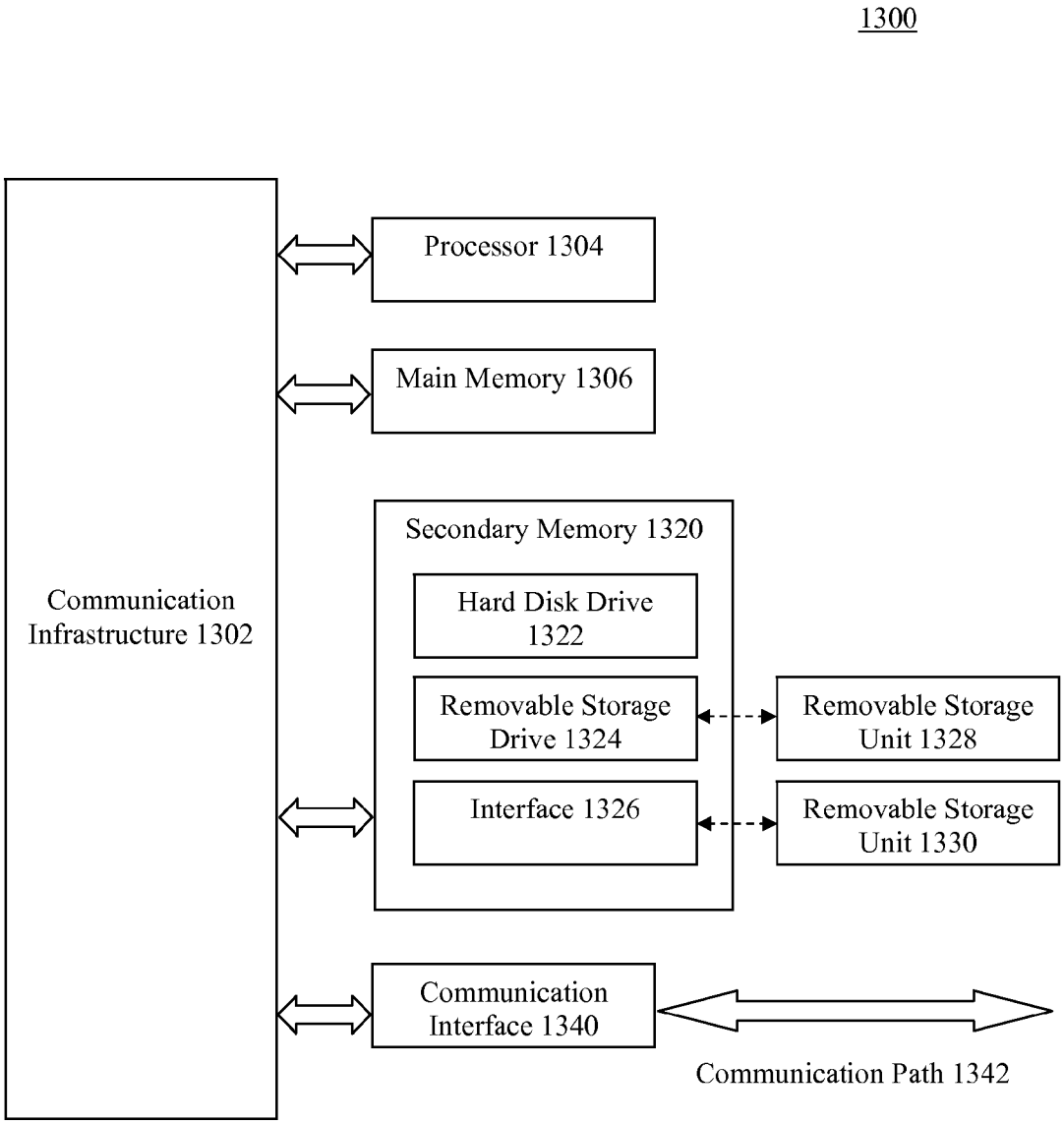
FIG. 13 is a block diagram of an example processor-based system that may be used to implement aspects of the present invention.

The following description of a general purpose computer system is provided for the sake of completeness. The present invention can be implemented in hardware, or as a combination of software and hardware. Consequently, the invention may be implemented in the environment of a computer system or other processing system. An example of such a computer system 1300 is shown in FIG. 13.

Computer system 1300 includes one or more processors, such as processor 1304. Processor 1304 can be a special purpose or a general purpose digital signal processor. Processor 1304 is connected to a communication infrastructure 1302 (for example, a bus or network). Various software implementations are described in terms of this exemplary computer system. After reading this description, it will become apparent to a person skilled in the relevant art(s) how to implement the invention using other computer systems and/or computer architectures.

Computer system 1300 also includes a main memory 1306, preferably random access memory (RAM), and may also include a secondary memory 1320. Secondary memory 1320 may include, for example, a hard disk drive 1322 and/or a removable storage drive 1324, representing a floppy disk drive, a magnetic tape drive, an optical disk drive, or the like. Removable storage drive 1324 reads from and/or writes to a removable storage unit 1328 in a well known manner. Removable storage unit 1328 represents a floppy disk, magnetic tape, optical disk, or the like, which is read by and written to by removable storage drive 1324. As will be appreciated by persons skilled in the relevant art(s), removable storage unit 1328 includes a computer usable storage medium having stored therein computer software and/or data.

In alternative implementations, secondary memory 1320 may include other similar means for allowing computer programs or other instructions to be loaded into computer system 1300. Such means may include, for example, a removable storage unit 1330 and an interface 1326. Examples of such means may include a program cartridge and cartridge interface (such as that found in video game devices), a removable memory chip (such as an EPROM, or PROM) and associated socket, and other removable storage units 1330 and interfaces 1326 which allow software and data to be transferred from removable storage unit 1330 to computer system 1300.

Computer system 1300 may also include a communications interface 1340. Communications interface 1340 allows software and data to be transferred between computer system 900 and external devices. Examples of communications interface 1340 may include a modem, a network interface (such as an Ethernet card), a communications port, a PCMCIA slot and card, etc. Software and data transferred via communications interface 1340 are in the form of signals which may be electronic, electromagnetic, optical, or other signals capable of being received by communications interface 1340. These signals are provided to communications interface 1340 via a communications path 1342. Communications path 1342 carries signals and may be implemented using wire or cable, fiber optics, a phone line, a cellular phone link, an RF link and other communications channels.

As used herein, the terms "computer program medium" and "computer usable medium" are used to generally refer to media such as removable storage units 1328 and 1330 or a hard disk installed in hard disk drive 1322. These computer program products are means for providing software to computer system 1300.

Computer programs (also called computer control logic) are stored in main memory 1306 and/or secondary memory 1320. Computer programs may also be received via communications interface 1340. Such computer programs, when executed, enable the computer system 1300 to implement the present invention as discussed herein. In particular, the computer programs, when executed, enable processor 1300 to implement the processes of the present invention, such as any of the methods or method steps described herein. Accordingly, such computer programs represent controllers of the computer system 1300. Where the invention is implemented using software, the software may be stored in a computer program product and loaded into computer system 1300 using removable storage drive 1324, interface 1326, or communications interface 1340.

In another embodiment, features of the invention are implemented primarily in hardware using, for example, hardware components such as application-specific integrated circuits (ASICs) and gate arrays. Implementation of a hardware state machine so as to perform the functions described herein will also be apparent to persons skilled in the relevant art(s).

F. Conclusion

While various embodiments of the present invention have been described above, it should be understood that they have been presented by way of example only, and not limitation. It will be understood by those skilled in the relevant art(s) that various changes in form and details may be made therein without departing from the spirit and scope of the invention as defined in the appended claims.

For example, the present invention has been described above with the aid of functional building blocks and method steps illustrating the performance of specified functions and relationships thereof. The boundaries of these functional building blocks and method steps have been arbitrarily defined herein for the convenience of the description. Alternate boundaries can be defined so long as the specified functions and relationships thereof are appropriately performed. Any such alternate boundaries are thus within the scope and spirit of the claimed invention. One skilled in the art will recognize that these functional building blocks can be implemented by discrete components, application specific integrated circuits, processors executing appropriate software and the like or any combination thereof. Thus, the breadth and scope of the present invention should not be limited by any of the above-described exemplary embodiments, but should be defined only in accordance with the following claims and their equivalents.

What is claimed is:

1. A system for enhancing the quality of an audio signal produced by an audio codec, comprising:

a pitch-based pre-filter that adaptively filters an input audio signal to produce a filtered audio signal, wherein adaptively filtering the input audio signal comprises filtering each of a plurality of segments of the input audio signal in a manner that is dependent upon an estimated pitch period associated therewith;

an audio encoder that encodes the filtered audio signal to generate a compressed audio bit stream;

an audio decoder that decodes the compressed audio bit stream to generate a decoded audio signal; and a pitch-based post-filter that adaptively filters the decoded audio signal to produce an output audio signal, wherein adaptively filtering the decoded audio signal comprises filtering each of a plurality of segments of the decoded audio signal in a manner that is dependent upon an estimated pitch period associated therewith, and wherein the pitch-based post-filter operates to undo at least part of a signal-shaping effect of the pitch-based pre-filter.

2. The system of claim 1, wherein the pitch-based pre-filter performs adaptive comb filtering of the input audio signal to suppress pitch harmonic peaks in the frequency domain when the input audio signal exhibits pitch periodicity; and wherein the pitch-based post-filter performs adaptive comb filtering of the decoded audio signal to boost pitch harmonic peaks in the frequency domain when the decoded audio signal exhibits pitch periodicity.

3. The system of claim 1, wherein the pitch-based pre-filter performs adaptive comb filtering of the input audio signal to boost spectral valleys between pitch harmonics in the frequency domain when the input audio signal exhibits pitch periodicity; and wherein the pitch-based post-filter performs adaptive comb filtering of the decoded audio signal to attenuate spectral valleys between pitch harmonics in the frequency domain when the decoded audio signal exhibits pitch periodicity.

4. The system of claim 1, wherein the pitch-based post-filter is an inverse filter of the pitch-based pre-filter.

5. The system of claim 1, further comprising:

a pitch parameter estimator that processes the input audio signal to determine pitch parameters that are used to configure the pitch-based pre-filter for each segment of the input audio signal, wherein the pitch parameters include the estimated pitch period associated with each segment of the input audio signal and one or more filter coefficients associated with each segment of the input audio signal;

a pitch parameter quantizer that quantizes and encodes the pitch parameters to generate a compressed pitch parameters bit stream; and a pitch parameter decoder that decodes the compressed pitch parameters bit stream to obtain decoded pitch parameters that are used to configure the pitch-based post-filter for each segment of the decoded audio signal.

6. The system of claim 1, further comprising:

a second audio decoder that decodes the compressed audio bit stream to generate a second decoded audio signal;

a first pitch parameter estimator that processes the second decoded audio signal to determine first pitch parameters that are used to configure the pitch-based pre-filter for each segment of the input audio signal, wherein the first pitch parameters include the estimated pitch period associated with each segment of the input audio signal and one or more filter coefficients associated with each segment of the input audio signal; and a second pitch parameter estimator that processes the decoded audio signal to determine second pitch parameters that are used to configure the pitch-based post-filter for each segment of the decoded audio signal, wherein the second pitch parameters include the estimated pitch period associated with each segment of the decoded audio signal and one or more filter coefficients associated with each segment of the decoded audio signal.

7. The system of claim 1, wherein each of the pitch-based pre-filter and the pitch-based post-filter includes at least one filter tap that is defined to be proportional to a parameter that measures a correlation between adjacent pitch cycle waveforms.

8. The system of claim 1, wherein each of the pitch-based pre-filter and the pitch-based post-filter is a single tap filter.

9. The system of claim 1, wherein each of the pitch-based pre-filter and the pitch-based post-filter is a multi-tap filter.

10. The system of claim 1, wherein the pitch-based pre-filter adaptively filters the input audio signal by adaptively filtering a predetermined sub-band of the input audio signal; and wherein the pitch-based post-filter adaptively filters the decoded audio signal by adaptively filtering a predetermined sub-band of the decoded audio signal.

11. The system of claim 1, wherein the pitch-based pre-filter comprises an all-zero Finite Impulse Response (FIR) filter $H_{pre}(z)=1-b\ z^{-p}$ and the pitch-based post-filter comprises an all-pole filter $$H_{post}(z) = \frac{1}{1 - bz^{-p}}.$$

12. The system of claim 1, wherein the pitch-based pre-filter performs an overlap-add operation of a first filtered signal produced by the filter $H_{pre}(z)=1-b\ z^{-p}$ when configured with pitch parameters corresponding to a current segment of the input audio signal and a second filtered signal produced by the filter $H_{0,pre}(z)=1-b_0\ z^{-p_0}$ when configured with pitch parameters corresponding to a previously-processed segment of the input audio signal to reduce discontinuities at segment boundaries of the filtered audio signal; and wherein the pitch-based post-filter performs an overlap-add operation of a third filtered signal produced by an all-zero FIR filter $b\ z^{-p}$ in a feedback branch of the all-pole filter $H_{post}(z)$ when configured with pitch parameters corresponding to a current segment of the input signal and a fourth filtered signal produced by the all-zero FIR filter $b_0\ z^{-p_0}$ when configured with pitch parameters corresponding to a previously-processed segment of the input audio signal to reduce discontinuities at segment boundaries of the output audio signal.

13. A method for enhancing the quality of an audio signal produced by an audio codec, comprising:

filtering each of a plurality of segments of an input audio signal by a pitch-based pre-filter in a manner that is dependent upon an estimated pitch period associated therewith to produce a filtered audio signal;

encoding the filtered audio signal in an audio encoder to generate a compressed audio bit stream; and providing the compressed audio bit stream to a system that includes an audio decoder that decodes the compressed audio bit stream to generate a decoded audio signal and a pitch-based post-filter that filters each of a plurality of segments of the decoded audio signal in a manner that is dependent upon an estimated pitch period associated therewith to undo at least part of a signal-shaping effect of the pitch-based pre-filter.

14. The method of claim 13, wherein filtering each of the plurality of segments of the input audio signal by the pitch-based pre-filter comprises performing adaptive comb filtering to suppress pitch harmonic peaks in the frequency domain when a segment of the input audio signal exhibits pitch periodicity; and wherein the pitch-based post-filter comprises a pitch-based post-filter that filters each of the plurality of segments of the decoded audio signal by performing adaptive comb filtering to boost pitch harmonic peaks in the frequency domain when a segment of the decoded audio signal exhibits pitch periodicity.

15. The method of claim 13, wherein filtering each of the plurality of segments of the input audio signal by the pitch-based pre-filter comprises performing adaptive comb filtering to boost spectral valleys between pitch harmonics in the frequency domain when a segment of the input audio signal exhibits pitch periodicity; and wherein the pitch-based post-filter comprises a pitch-based post-filter that filters each of the plurality of segments of the decoded audio signal by performing adaptive comb filtering to attenuate spectral valleys between pitch harmonics in the frequency domain when a segment of the decoded audio signal exhibits pitch periodicity.

16. A method for enhancing the quality of an audio signal produced by an audio codec, comprising:

receiving a compressed audio bit stream generated by a system that includes a pitch-based pre-filter that filters each of a plurality of segments of an input audio signal in a manner that is dependent upon an estimated pitch period associated therewith to produce a filtered audio signal and an audio encoder that encodes the filtered audio signal to generate the compressed audio bit stream;

decoding the compressed audio bit stream in an audio decoder to generate a decoded audio signal; and filtering each of a plurality of segments of the decoded audio signal by a pitch-based post-filter in a manner that is dependent upon an estimated pitch period associated therewith to produce an output audio signal, wherein the filtering operates to undo at least part of a signal-shaping effect of the pitch-based pre-filter.

17. The method of claim 16, wherein the pitch-based pre-filter filters comprises a pitch-based pre-filter that filters each of the plurality of segments of the input audio signal by performing adaptive comb filtering to suppress pitch harmonic peaks in the frequency domain when a segment of the input audio signal exhibits pitch periodicity; and wherein filtering each of the plurality of segments of the decoded audio signal by a pitch-based post-filter comprises performing adaptive comb filtering to boost pitch harmonic peaks in the frequency domain when a segment of the decoded audio signal exhibits pitch periodicity.

18. The method of claim 16, wherein the pitch-based pre-filter comprises a pitch-based pre-filter that filters each of the plurality of segments of the input audio signal by performing adaptive comb filtering to boost spectral valleys between pitch harmonics in the frequency domain when a segment of the input audio signal exhibits pitch periodicity; and wherein filtering each of the plurality of segments of the decoded audio signal by a pitch-based post-filter comprises performing adaptive comb filtering to attenuate spectral valleys between pitch harmonics in the frequency domain when a segment of the decoded audio signal exhibits pitch periodicity.

19. A method for avoiding frame boundary discontinuities when performing pitch-based pre-filtering and pitch-based post-filtering of an audio signal, comprising:

(a) obtaining a first set of filter parameters associated with a previously-received frame of the audio signal, wherein at least one parameter in the first set of filter parameters is determined based on an estimated pitch period associated with the previously-received frame;

(b) obtaining a second set of filter parameters associated with a current frame of the audio signal, wherein at least one parameter in the second set of filter parameters is determined based on an estimated pitch period associated with the current frame; and (c) for each of a predetermined number of samples at a beginning of the current frame, consecutively performing an operation that effectively calculates and overlap adds a first filtered audio signal sample that corresponds to the sample of the current frame and is obtained using the first set of filter parameters and a second filtered audio signal sample that corresponds to the sample of the current frame and is obtained using the second set of filter parameters, thereby obtaining a corresponding sample of a filter output signal.

20. The method of claim 19, wherein step (c) comprises performing, for consecutive values of an index n from 1 to K:

$$\tilde{s}(n)=d(n)+w_o(n)b_0\tilde{s}(n-p_0)+w_i(n)b\tilde{s}(n-p);$$

wherein K represents the predetermined number of samples at the beginning of the current frame, $\tilde{s}(n)$ represents an n-th sample of the filter output signal, $\tilde{d}(n)$ represents an n-th sample of a filter input signal, $b_0$ represents a filter tap associated with the previously-received frame, $p_0$ represents the estimated pitch period associated with the previously-received frame, b represents a filter tap associated with the current frame, p represents the estimated pitch period associated with the current frame, $w_0$ represents an n-th coefficient of a fade-out window, and $w_i$ represents an n-th coefficient of a fade-in window.

21. A system, comprising:

an audio encoder that includes:

a band splitter that splits an input audio signal into at least a first sub-band audio signal and a second sub-band audio signal, a pitch-based pre-filter that filters the first sub-band audio signal to produce a pre-filtered first sub-band audio signal, a first sub-band encoder that encodes the pre-filtered first sub-band audio signal to produce an encoded first sub-band audio signal, a second sub-band encoder that encodes the second sub-band audio signal to produce an encoded second sub-band audio signal, and a bit multiplexer that combines at least the encoded first sub-band audio signal and the encoded second sub-band audio signal to generate a compressed audio bit stream; and an audio decoder that includes:

a bit demultiplexer that obtains at least the encoded first sub-band audio signal and the encoded second sub-band audio signal from the compressed audio bit stream, a first sub-band decoder that decodes the encoded first sub-band audio signal to produce a decoded first sub-band audio signal, a second sub-band decoder that decodes the encoded second sub-band audio signal to produce a decoded second sub-band audio signal, a pitch-based post-filter that filters the decoded first sub-band audio signal to produce a post-filtered decoded first sub-band audio signal, and a band combiner that combines at least the post-filtered decoded first sub-band audio signal and the decoded second sub-band audio signal to produce an output audio signal.

* * * * *

UNITED STATES PATENT AND TRADEMARK OFFICE

CERTIFICATE OF CORRECTION

PATENT NO. : 8,738,385 B2
APPLICATION NO. : 13/172134
DATED : May 27, 2014
INVENTOR(S) : Juin-Hwey Chen It is certified that error appears in the above-identified patent and that said Letters Patent is hereby corrected as shown below:

In the Claims:

In column 26, line 3, in claim 20, delete "$d(n)$" and insert -- $\tilde{d}(n)$ --, therefor.

Signed and Sealed this
Seventh Day of October, 2014

Michelle K. Lee

Michelle K. Lee
*Deputy Director of the United States Patent and Trademark Office*